US010543413B2

(12) United States Patent
Nelson et al.

(10) Patent No.: US 10,543,413 B2
(45) **Date of Patent: *Jan. 28, 2020**

(54) SPORTS SKILLS TRAINING APPARATUS

(71) Applicant: TRIAD SPORTS GROUP, LLC, Camarillo, CA (US)

(72) Inventors: David Nelson, Camarillo, CA (US); John Lucas, Camarillo, CA (US)

(73) Assignee: TRIAD SPORTS GROUP, LLC, Camarillo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/149,602

(22) Filed: Oct. 2, 2018

(65) Prior Publication Data

US 2019/0046856 A1 Feb. 14, 2019

Related U.S. Application Data

(63) Continuation of application No. 15/904,288, filed on Feb. 23, 2018, now Pat. No. 10,226,679, which is a (Continued)

(51) Int. Cl.
*A63B 63/00* (2006.01)
*A63B 69/00* (2006.01)

(Continued)

(52) U.S. Cl.
CPC ..... *A63B 69/00* (2013.01); *A63B 61/00* (2013.01); *A63B 63/00* (2013.01); *A63B 71/022* (2013.01);

(Continued)

(58) Field of Classification Search
CPC . A63B 2210/52; A63B 2210/54; A63B 61/02; A63B 61/04; A63B 63/00; A63B 63/004; A63B 63/04; A63B 2210/50

(Continued)

(56) References Cited

U.S. PATENT DOCUMENTS 1,922,021 A 8/1933 Adams
3,013,801 A 12/1961 Kirkconnell, Jr.

(Continued)

FOREIGN PATENT DOCUMENTS

DE 202013104280 U1 10/2013
JP D1191670 S 12/2003

(Continued)

OTHER PUBLICATIONS

Bownet, Bownet Portable Lacrosse Goal, YouTube video (Jan. 11, 2009): https://www.youtube.com/watch?v=avtL47x4yoo.

(Continued)

*Primary Examiner* — Mark S Graham
(74) *Attorney, Agent, or Firm* — Arent Fox, LLP

(57) ABSTRACT

A training apparatus arranged to be portable, collapsible, and able to be configured into different arrangements for different nets and/or different sports-related activities. The training apparatus comprises a support portion, base poles pivotally coupled to the support portion, base brackets coupled to the base poles opposite the support portion, extensions coupled to the base brackets, first and second flexible rods removably coupled to the support portion, and a net configured to be received by the flexible rods. The net is configured to bend the first and second flexible rods from a linear state to an arcuate state, such that a net tension holds the net upright.

20 Claims, 19 Drawing Sheets

Related U.S. Application Data continuation of application No. 15/588,434, filed on May 5, 2017, which is a continuation of application No. 15/230,210, filed on Aug. 5, 2016, now Pat. No. 9,795,849, which is a continuation-in-part of application No. 15/068,354, filed on Mar. 11, 2016, now Pat. No. 9,750,996, which is a continuation of application No. 13/485,775, filed on May 31, 2012, now Pat. No. 9,283,455, said application No. 15/904,288 is a continuation-in-part of application No. 15/612,899, filed on Jun. 2, 2017, which is a continuation of application No. 15/068,354, filed on Mar. 11, 2016, now Pat. No. 9,750,996, which is a continuation of application No. 13/485,775, filed on May 31, 2012, now Pat. No. 9,283,455.

(60) Provisional application No. 62/462,802, filed on Feb. 23, 2017, provisional application No. 62/287,356, filed on Jan. 26, 2016, provisional application No. 61/492,010, filed on Jun. 1, 2011.

(51) Int. Cl.
*A63B 61/00* (2006.01)
*A63B 71/02* (2006.01)
*A63B 102/18* (2015.01)

(52) U.S. Cl.
CPC ..... *A63B 2071/026* (2013.01); *A63B 2102/18* (2015.10); *A63B 2209/02* (2013.01); *A63B 2210/50* (2013.01); *A63B 2225/055* (2013.01); *A63B 2243/0025* (2013.01)

(58) Field of Classification Search
USPC ..... 273/398–402, 395, 396; 473/478, 434, 473/435, 490, 492–495
See application file for complete search history.

(56) References Cited

U.S. PATENT DOCUMENTS 3,039,770 A 6/1962 Ferretti
3,195,898 A 7/1965 Respini
3,197,208 A 7/1965 Makar
3,428,319 A 2/1969 Engle
3,583,703 A 6/1971 Brown
4,093,218 A 6/1978 Burchers
4,173,340 A 11/1979 Kanno
4,258,915 A 3/1981 Sellge, Jr.
4,274,632 A 6/1981 Jacobs
4,456,251 A 6/1984 Balaz
4,489,941 A 12/1984 Shieh
4,723,780 A 2/1988 Vinzetta
5,080,375 A 1/1992 Moosavi
5,100,134 A 3/1992 Becker
5,118,103 A 6/1992 Miller
5,249,796 A 10/1993 Silvi
5,269,527 A 12/1993 Noval
5,269,533 A 12/1993 Kellams
5,333,856 A 8/1994 Gery
5,539,957 A 7/1996 Schmidt
5,562,288 A 10/1996 Erkebaev
5,564,711 A 10/1996 Scheie
5,569,102 A 10/1996 Karron
D377,673 S 1/1997 Henrickson
5,681,045 A 10/1997 Liao
5,690,339 A 11/1997 Chen
5,746,533 A 5/1998 Schmidt
5,816,946 A 10/1998 Grossman
5,816,956 A 10/1998 Ellis et al.
5,839,733 A 11/1998 Meeks et al.
D415,805 S 10/1999 Wygonik
6,210,288 B1 4/2001 Kim
6,299,554 B1 10/2001 Sinclair
6,315,677 B1 11/2001 Sandlin
6,358,163 B1 3/2002 Tanner
6,371,873 B1 4/2002 Wang
6,511,390 B2 1/2003 Kim
6,672,980 B1 1/2004 Walsh
6,682,445 B1 1/2004 Tanner
6,716,123 B1 4/2004 Chen
D514,638 S 2/2006 deGrasse
D531,684 S 11/2006 Bouffard et al.
7,371,195 B2 5/2008 Stevens
D591,358 S 4/2009 Moore
D627,002 S 11/2010 Cho
D638,079 S 5/2011 Cheng
8,216,092 B2 7/2012 Wennesland
8,216,093 B2 7/2012 Chen
8,246,496 B2 8/2012 Holland et al.
8,579,737 B2 11/2013 Holland et al.
8,734,274 B1 5/2014 Hochberg
D709,970 S 7/2014 Holland
8,875,772 B1 11/2014 Dixon, Jr.
9,126,127 B2 9/2015 Jablonski
9,162,127 B2 10/2015 Holland et al.
9,220,965 B1 12/2015 Hochberg
9,283,455 B2 3/2016 Nelson
9,480,894 B2 11/2016 Holland et al.
9,750,996 B2 9/2017 Nelson
9,795,849 B2 10/2017 Nelson
9,795,857 B2 10/2017 Nelson
9,999,816 B2 6/2018 Holland et al.
10,124,233 B2 11/2018 Nelson
10,183,206 B2 1/2019 Nelson
10,226,679 B2 * 3/2019 Nelson ..... A63B 69/00
2002/0193186 A1 12/2002 Kim
2003/0036446 A1 2/2003 Udwin et al.
2003/0153412 A1 8/2003 Duba et al.
2004/0036222 A1 2/2004 Chou
2004/0127308 A1 7/2004 Swanson
2004/0138011 A1 7/2004 Lin
2004/0185968 A1 9/2004 Livingstone
2005/0266936 A1 12/2005 Gutierrez
2006/0019773 A1 1/2006 Newman
2006/0205540 A1 9/2006 Liu
2006/0232013 A1 10/2006 Quinn
2007/0087869 A1 4/2007 Lin
2007/0105662 A1 5/2007 Tanner
2007/0281805 A1 12/2007 Hsiao
2008/0064534 A1 3/2008 Lortscher
2008/0139343 A1 6/2008 Sandman
2009/0082140 A1 3/2009 Liao
2010/0184538 A1 7/2010 Reeves
2010/0304902 A1 12/2010 Holland et al.
2011/0074111 A1 3/2011 Jackson
2011/0136592 A1 6/2011 Keller
2011/0230284 A1 9/2011 Simon
2011/0287872 A1 11/2011 Lynch
2012/0172153 A1 7/2012 Newman
2012/0190482 A1 7/2012 Cottreau
2013/0175414 A1 7/2013 Nelson
2013/0210554 A1 8/2013 Carlson
2013/0252766 A1 9/2013 Nelson
2013/0303313 A1 11/2013 Chen
2014/0171225 A1 6/2014 Paulson
2014/0295999 A1 10/2014 Robinson
2014/0364255 A1 12/2014 Nelson
2015/0057109 A1 2/2015 Chen
2015/0148152 A1 5/2015 Holland
2015/0151179 A1 6/2015 Holland et al.
2015/0165289 A1 6/2015 Chen
2015/0231470 A1 8/2015 Kanner
2016/0023072 A1 1/2016 Holland et al.
2016/0096097 A1 4/2016 Erlandson
2017/0056741 A1 3/2017 Nelson
2017/0106266 A1 4/2017 Nelson
2017/0304701 A1 10/2017 Nelson et al.
2018/0185727 A1 7/2018 Nelson et al.

(56) References Cited

U.S. PATENT DOCUMENTS

FOREIGN PATENT DOCUMENTS

| | | | |
|---|---|---|---|
| JP | D1200560 | S | 3/2004 |
| JP | 3100716 | U | 5/2004 |
| JP | 2011024660 | A | 2/2011 |
| KR | 920008138 | Y1 | 11/1992 |
| WO | 2012167155 | A2 | 12/2012 |

OTHER PUBLICATIONS

Bownet, The Bownet Will Take Abuse, YouTube video (Nov. 18, 2008): https://www.youtube.com/watch?v=0Ih51KY0bFA.
Bownet, Bownet Big Mouth, YouTube video (Jan. 21, 2009): https://www.youtube.com/watch?v=D6HAraGpAdl.
Bownet, Strike Zone Set Up, YouTube video (Jan. 25, 2009): https://www.youtube.com/watch?v=Y0EJjJaVz-o.
Bownet, US Lacrosse Convention 2009, YouTube video (Jan. 26, 2009): https://www.youtube.com/watch?v=erxobnMRsfQ.
Bownet, Strike Zone Pitching, YouTube video (Feb. 18, 2009): https://www.youtube.com/watch?v=h6_84TtFUI4.
Bownet, Sandbag Demo, YouTube video (Jul. 14, 2009): https://www.youtube.com/watch?v=KraTVKH549g.
Bownet, Backstop Drills, YouTube video (Jul. 15, 2009): https://www.youtube.com/watch?v=e-26ils7tXo.
Bownet, 7×14 Training Session, YouTube video (Oct. 24, 2009): https://www.youtube.com/watch?v=y-x9GGu4aaY.
Bownet, Soft Toss and Bigmouth Demo, YouTube video (Nov. 23, 2009): https://www.youtube.com/watch?v=IGdgSoTLLNY.
Bownet, Soccer Net Demo, YouTube video (Nov. 24, 2009): https://www.youtube.com/watch?v=4LOxlwoUzRA.
Bownet, Crease Set Up-Down, YouTube video (Dec. 31, 2009): https://www.youtube.com/watch?v=nKApo0tsj1c.
Bownet, Barrier Net Soccer Demo, YouTube video (Jan. 18, 2010): https://www.youtube.com/watch?v=0NZ86SWigxM.
Bownet, DMS11 Practice, YouTube video (Feb. 19, 2010): https://www.youtube.com/watch?v=OaW5j9_FrA4.
Bownet, Final Bownet Guard1, YouTube video (Mar. 11, 2010): https://www.youtube.com/watch?v=od8OHFFM1dU.
Bownet, Bownet 8×24, YouTube video (Oct. 21, 2010): https://www.youtube.com/watch?v=XKLsGhbhRvE.
Bownet, Bownet SnapZone Set Up, YouTube video (Jan. 5, 2011): https://www.youtube.com/watch?v=MDrlqmTfHVA.
Bownet, Lacrosse Demo 2011, YouTube video (Jan. 19, 2011): https://www.youtube.com/watch?v=OAimgUUXHmk.
Bownet, Bownet Soccer Demo, YouTube video (Jan. 18, 2010): https://www.youtube.com/watch?v=ORrlbNSvhdw.
Bownet, Ladies Crease and 8m Arc Set Up, YouTube video (Nov. 9, 2011): https://www.youtube.com/watch?v=ohF81rLyTPM.
Bownet, Ladies 8m Arc Take Down, YouTube video (Jan. 30, 2012): https://www.youtube.com/watch?v=VvTZI9pYlic.
Bownet, Volleyball Setting Net Demo, YouTube video (Apr. 16, 2012): https://www.youtube.com/watch?v=FWfcXVKly28.
Bownet, Bownet Solo Kicker, YouTube video (Jan. 4, 2011): https://www.youtube.com/watch?v=-efeeqAy0xE.
Bownet, The Mini YouTube video (Nov. 18, 2008): https://www.youtube.com/watch?v=U0gBsj1Qgdg.
Bownet, Bownet Lacrosse (LAX), YouTube video (Nov. 18, 2008): https://www.youtube.com/watch?v=AJGAIG3NzdM.
Bownet, Big Mouth Drills, YouTube video (Jan. 6, 2009): https://www.youtube.com/watch?v=XjD1EBBf3rl.
Bownet, 7×14 SetUp, YouTube video (Jul. 14, 2009): https://www.youtube.com/watch?v=hTVhyRfq5u0.
Bownet, Barrier Net Set Up, YouTube video (Feb. 28, 2010): https://www.youtube.com/watch?v=bcRc9Yy9-hc.
Bownet, 6.5×18 SetUp, YouTube video (Jul. 14, 2009): https://www.youtube.com/watch?v=Kaq3YCkObi0.
Bownet, Backstop Up & Down, YouTube video (Jul. 15, 2009): https://www.youtube.com/watch?v=gfqHjPfWuq8.
Bownet, Barrier Net 'Take Down'.mov, YouTube video (Mar. 4, 2010): https://www.youtube.com/watch?v=iyazwJe70fl.
Bownet, BowNet 5×10 shots, YouTube video (Jan. 20, 2009): https://www.youtube.com/watch?v=oDS0doGxKqU.
Bownet, BowNet 6×12 shots, YouTube video (Jan. 20, 2009): https://www.youtube.com/watch?v=KTVdKSRrPwg.
Bownet, Bownet Screen Pitching, YouTube video (Jan. 6, 2009): https://www.youtube.com/watch?v=71u-vOs3TV4.
Bownet, Lacrosse Demo.mov, YouTube video (Jan. 3, 2010): https://www.youtube.com/watch?v=ar6WspWjP3w.
Bownet, SetUp New 4×8, YouTube video (Jul. 14, 2009): https://www.youtube.com/watch?v=evSHIhEVcsU.
Bownet, Softtoss net set up, YouTube video (Jan. 21, 2009): https://www.youtube.com/watch?v=yD2HM9RHcxo.
Bownet, The BowNet 5×10, YouTube video (Jan. 20, 2009): https://www.youtube.com/watch?v=jP3TW1nEoEs.
Bownet, The BowNet 6×12, YouTube video (Jan. 20, 2009): https://www.youtube.com/watch?v=kipbgs1ULWA.
Bownet, 12'×3' Barrier/Tennis Net Set Up, YouTube video (Jan. 10, 2011): https://www.youtube.com/watch?v=MX08s9Djf8s.
Bownet, 18'×2' 9" Portable Barrier/Tennis Net Set Up, YouTube video (Nov. 6, 2011): https://www.youtube.com/watch?v=IOVRkq_hIXs.
Bownet, 18' Youth Tennis Net Take Down, YouTube video (Nov. 9, 2011): https://www.youtube.com/watch?v=7qySTevtZH8.
Bownet, Bownet 8×24 Set Up, YouTube video (Jan. 9, 2011): https://www.youtube.com/watch?v=Oapc5oXdhSc.
Bownet, Bownet 8×24 Take Down, YouTube video (Jan. 9, 2011): https://www.youtube.com/watch?v=CbFmS61t0vY.
Bownet, Bownet Solo Kicker Set Up, YouTube video (Jan. 5, 2011): https://www.youtube.com/watch?v=aAQVIISKo-Y.
Bownet, Bownet Solo Kicker Take Down, YouTube video (Jan. 5, 2011): https://www.youtube.com/watch?v=AI3UBhsNVM8.
Bownet, Can't Knock Down The Bownet, YouTube video (Dec. 19, 2011): https://www.youtube.com/watch?v=0xC2xECHJ84.
Bownet, Field Hockey Take Down, YouTube video (Nov. 15, 2011): https://www.youtube.com/watch?v=zVrmvMWuF_A.
Bownet, Field Hockey Set Up, YouTube video (Nov. 15, 2011): https://www.youtube.com/watch?v=aY5Y9kpebJA.
Bownet, Hitting Station Set Up, YouTube video (Nov. 6, 2011): https://www.youtube.com/watch?v=0R2eK8xiyUY.
Bownet, Hitting Station Take Down, YouTube video (Dec. 4, 2011): https://www.youtube.com/watch?v=6E3bHzBVRL4.
Bownet, Lacrosse Halo Set Up, YouTube video (Jan. 18, 2011): https://www.youtube.com/watch?v=5jSR28apetA.
Bownet, L' Screen Set Up, YouTube video (Dec. 15, 2011): https://www.youtube.com/watch?v=id7oYUqDqIw.
Bownet, Pitching Screen Demo, YouTube video (Dec. 15, 2011): https://www.youtube.com/watch?v=-ullBby-opQ.
Bownet, QB5 Pocket Net Take Down, YouTube video (Dec. 4, 2011): https://www.youtube.com/watch?v=S4rISPDB2nc.
Bownet, QB5 'Set Up', YouTube video (Dec. 4, 2011): https://www.youtube.com/watch?v=eIGJ2sgw8GM.
Bownet, Solo Kicker Demo, YouTube video (Jun. 13, 2011): https://www.youtube.com/watch?v=4I-8PMhP5Aw.
Bownet, Volleyball Hitting Station Demo, YouTube video (Apr. 13, 2012): https://www.youtube.com/watch?v=_LieCF1_dM0.
Bownet, Volleyball Hitting Station Set Up, YouTube video (Nov. 9, 2011): https://www.youtube.com/watch?v=peQf6U2bXxE.
Bownet, Volleyball Hitting Station Take Down (Nov. 9, 2011): YouTube video, https://www.youtube.com/watch?v=iP-BmT-72g.
International Search Report and Written Opinion for PCT/US2012/040557, dated Dec. 14, 2012.
International Search Report and Written Opinion for PCT/US2012/040557, dated Dec. 12, 2013.

* cited by examiner

FIG. 2c
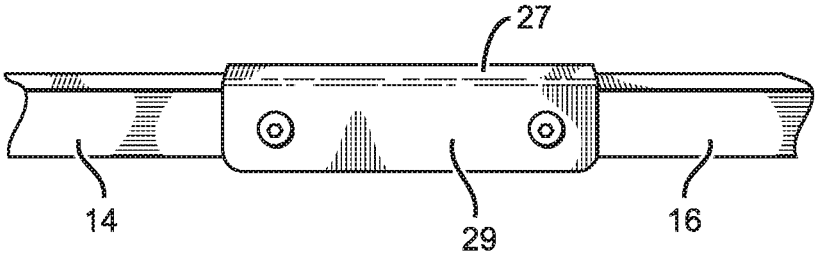
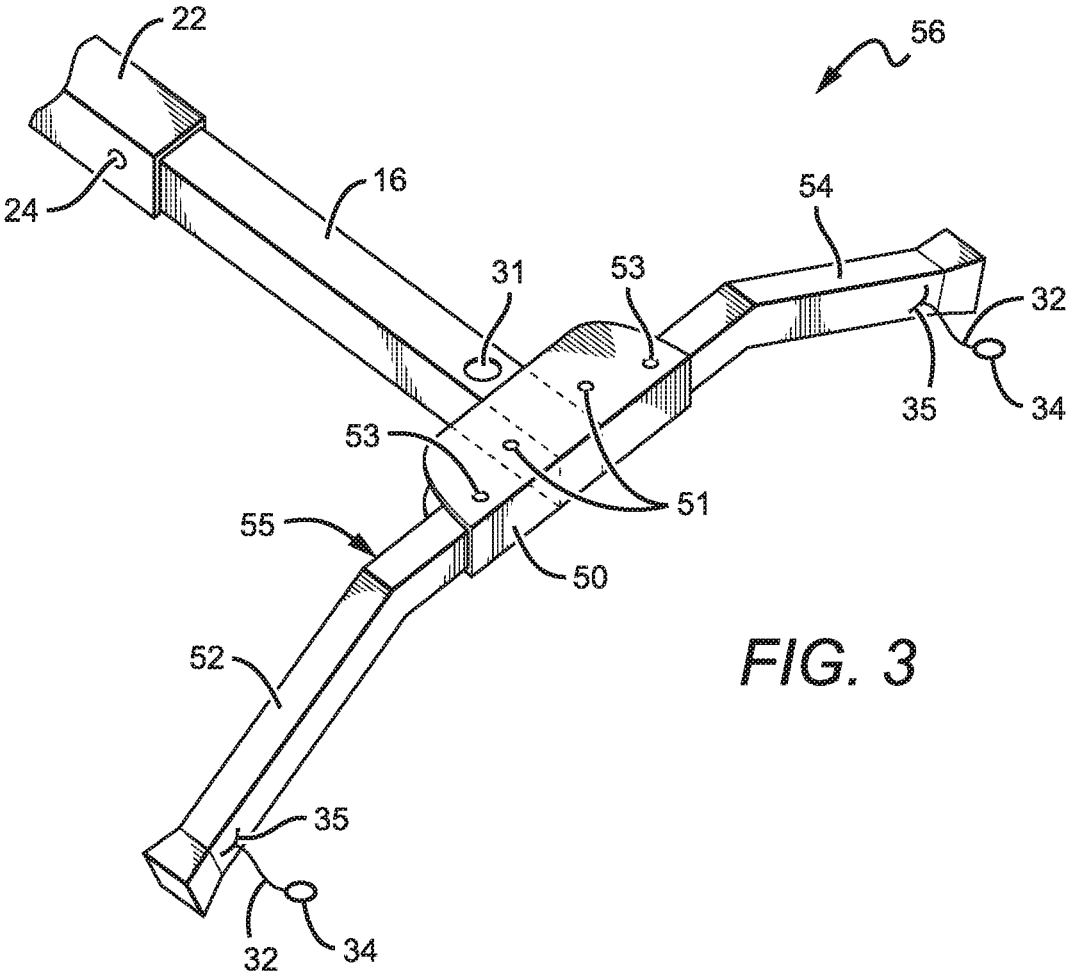
FIG. 3

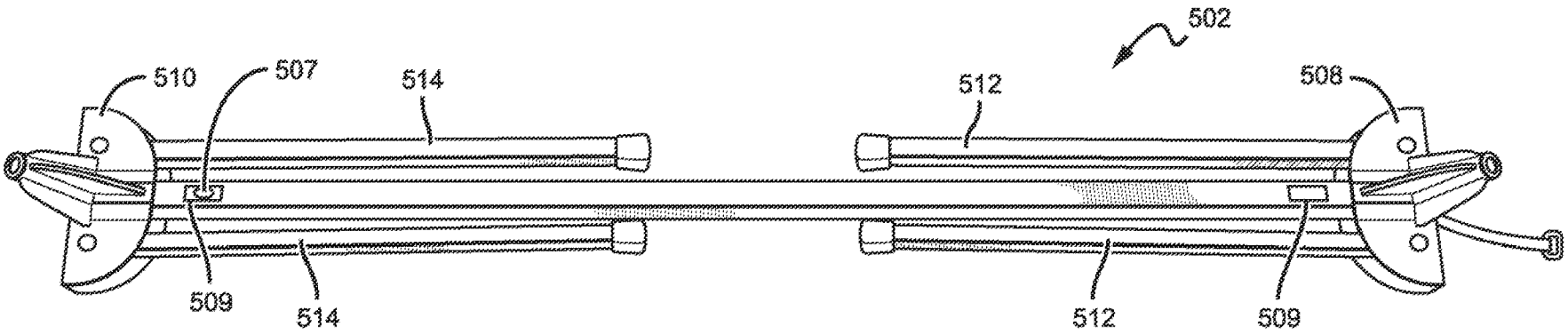
FIG. 9
FIG. 10
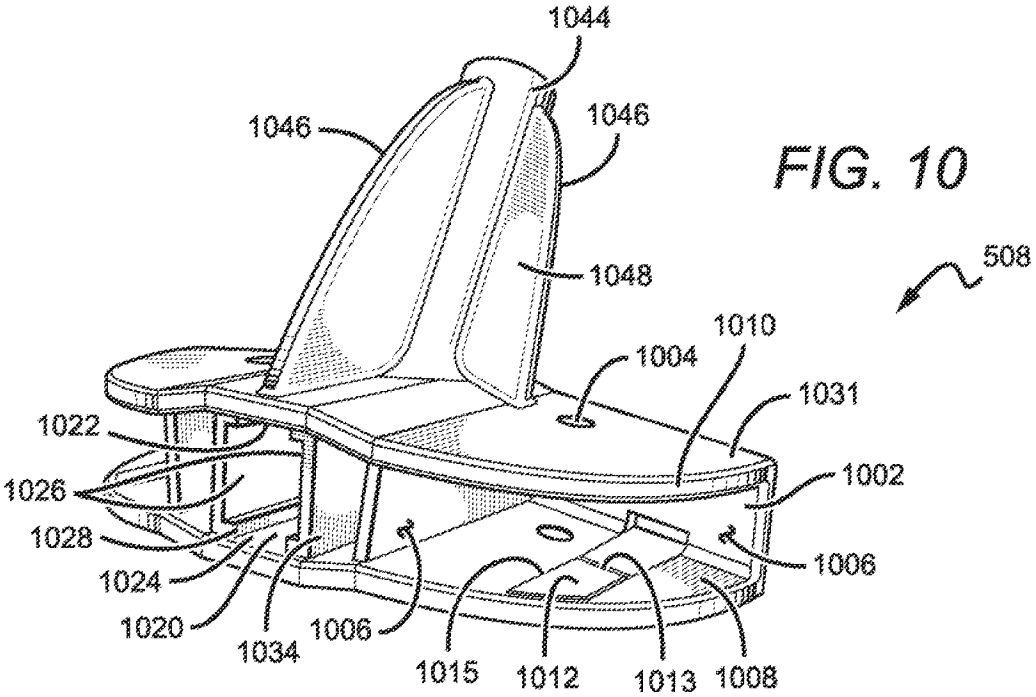

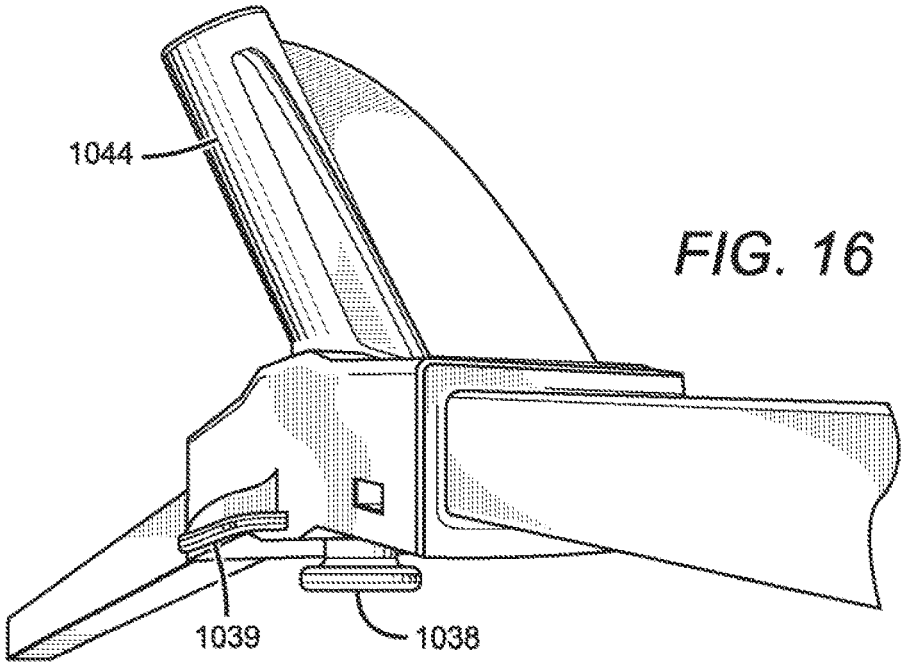
FIG. 16
FIG. 17
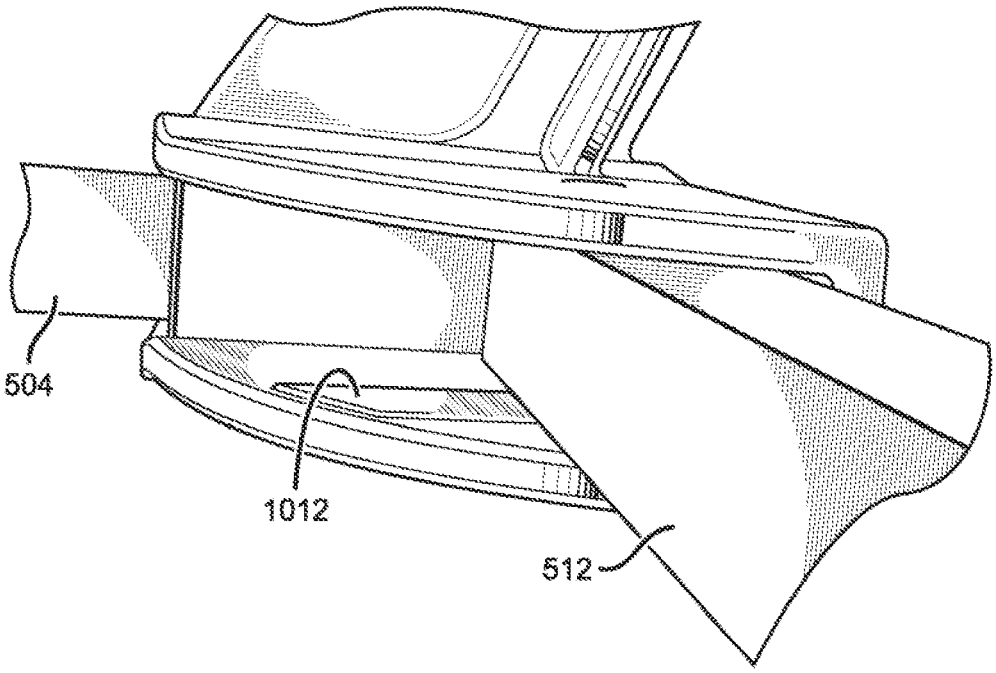

FIG. 26
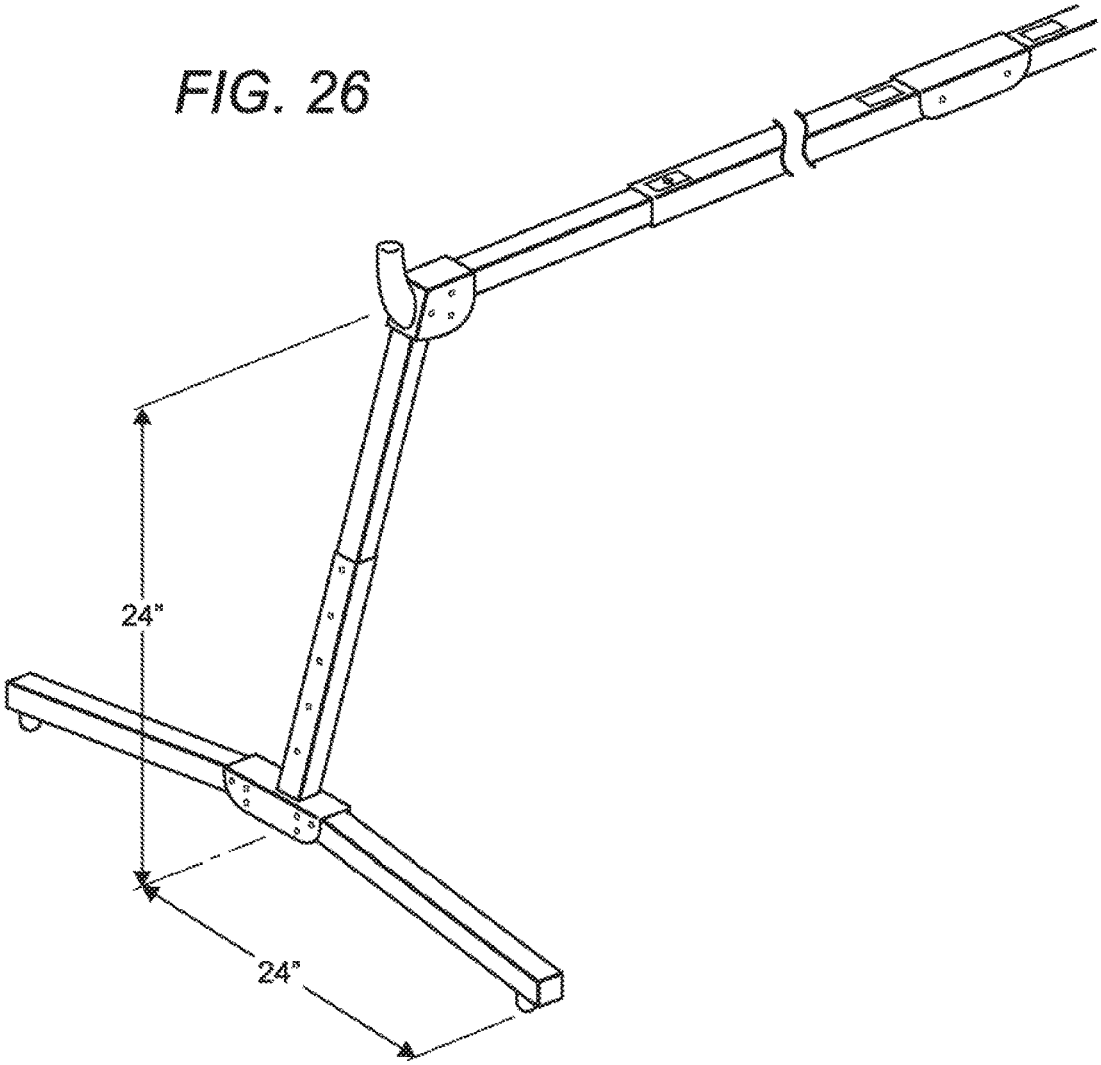
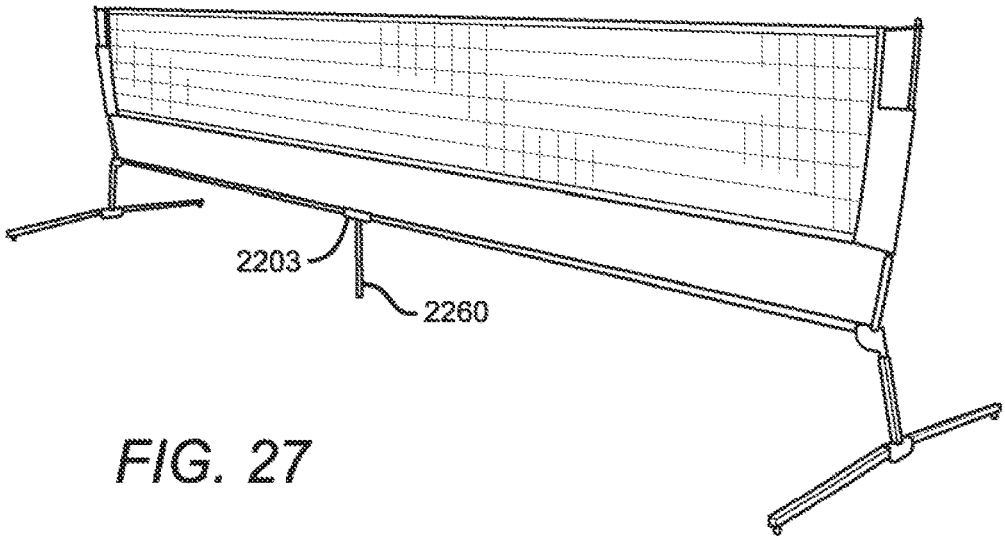
FIG. 27

FIG. 29
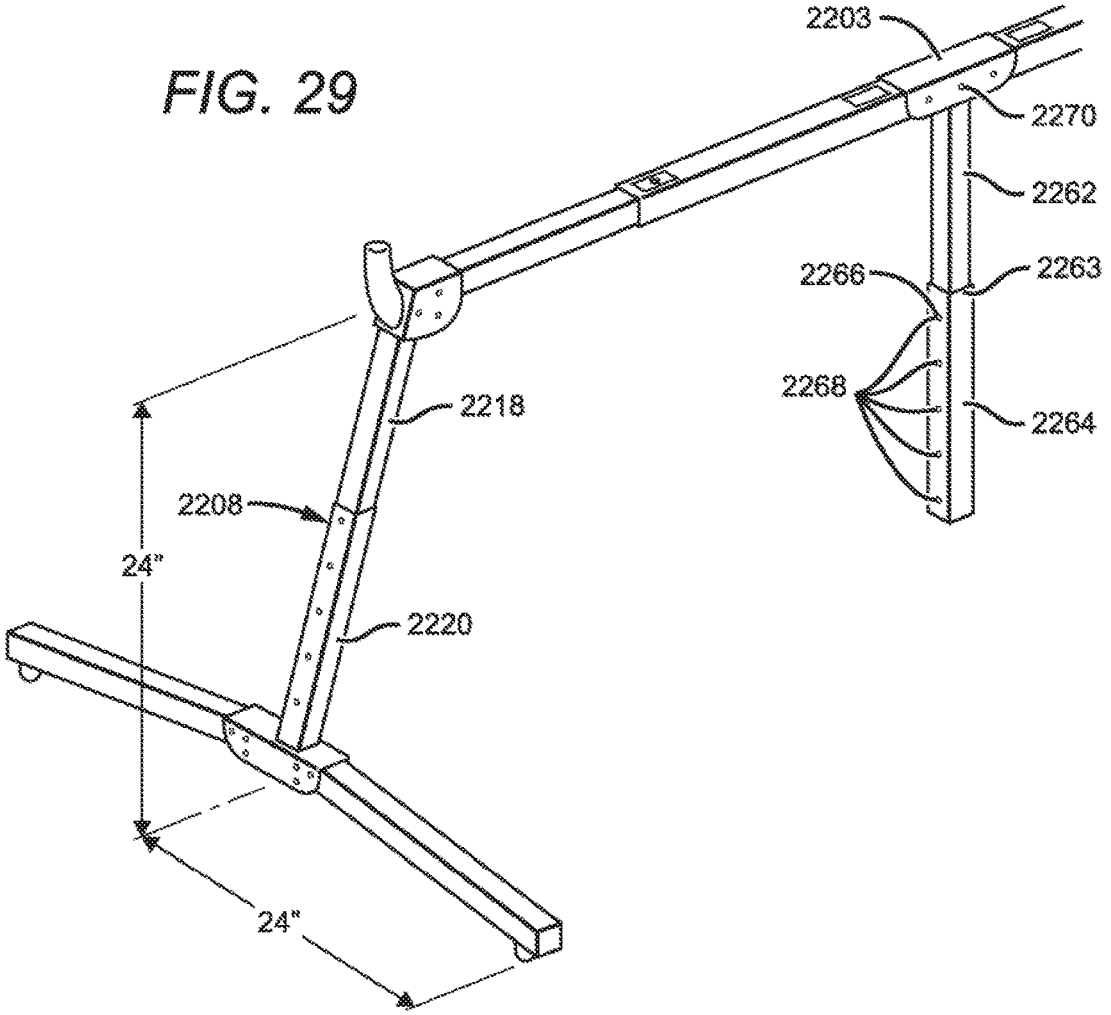
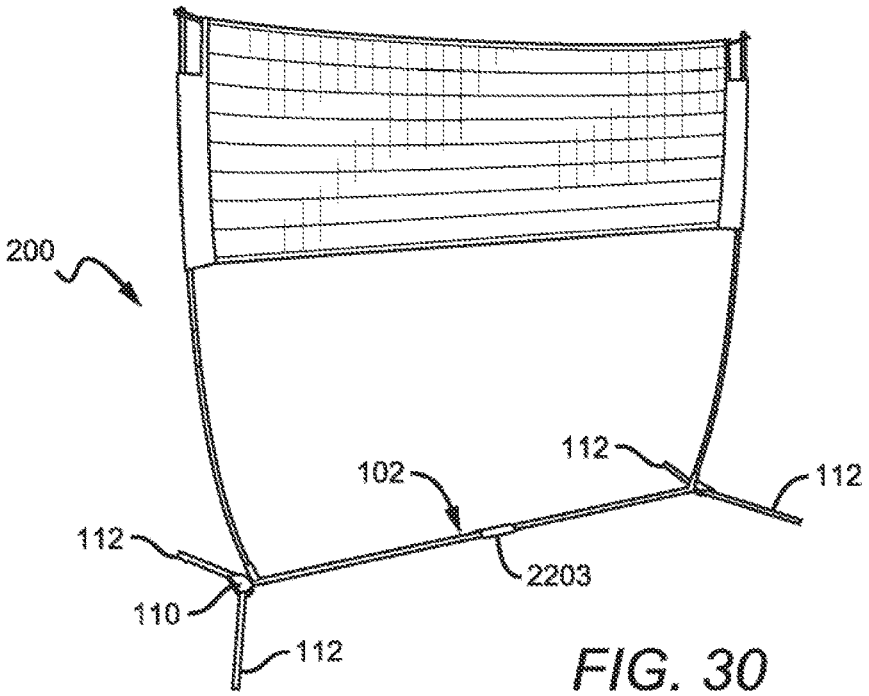
FIG. 30

SPORTS SKILLS TRAINING APPARATUS

RELATED APPLICATION

This application is a continuation of Ser. No. 15/904,288 to David Nelson et al., filed Feb. 23, 2018, which claims the benefit of priority of U.S. Provisional Application Ser. No. 62/462,802, filed Feb. 23, 2017. Ser. No. 15/904,288 is a continuation in part application of Ser. No. 15/588,434 to David Nelson et al., filed on May 5, 2017, which is a continuation application of Ser. No. 15/230,210 to David Nelson et al., filed on Aug. 5, 2016, now U.S. Pat. No. 9,795,849, which claims the benefit of priority of U.S. Provisional Application Ser. No. 62/287,356, filed on Jan. 26, 2016, which is a continuation in part application of Ser. No. 15/068,354 to David Nelson et al., filed on Mar. 11, 2016, now U.S. Pat. No. 9,750,996, which is a continuation application of Ser. No. 13/485,775 to David Nelson et al., filed on May 31, 2012, now U.S. Pat. No. 9,283,455, which claims the benefit of priority of U.S. Provisional Application Ser. No. 61/492,010, filed on Jun. 1, 2011. Ser. No. 15/904,288 is a continuation in part application of Ser. No. 15/612,899 to David Nelson et al., filed on Jun. 2, 2017, which is a continuation application of Ser. No. 15/068,354 to David Nelson et al., filed on Mar. 11, 2016, now U.S. Pat. No. 9,750,996, which is a continuation application of Ser. No. 13/485,775 to David Nelson et al., filed on May 31, 2012, now U.S. Pat. No. 9,283,455, which claims the benefit of priority of U.S. Provisional Application Ser. No. 61/492,010, filed on Jun. 1, 2011. The contents of Ser. Nos. 13/485,775, 15/068,354, 15/230,210, 15/588,434, 15/612,899, 15/904,288, 61/492,010, 62/287,356, and 62/462,802, including their drawings, schematics, diagrams and written description, are hereby incorporated in their entirety by reference.

BACKGROUND

Field

This disclosure relates to a sports skills training apparatus adapted to be used in sports-related activities. More specifically, the disclosure is directed to a customizable sports skill training apparatus that is configured to be collapsible to allow for ease of portability, transport and assembly.

Description of the Related Art

Various sports such as soccer, baseball, or volleyball involve hitting or throwing projectiles such as soccer balls, baseballs or volleyballs toward a desired direction in a field. A number of sports games are conducted on a playing field and involve a player hitting or throwing a game ball away from an opponent to be successful. For practice purposes, it is desirable to capture the ball before it travels a large distance or strikes objects or people, or provide a net or obstacle that the game ball must travel over to assist players in improving their skills in striking the game ball over the net or obstacle. Existing capturing structures include a net attached to the perimeter of a capturing frame and a rigid support frame attached to the capturing frame. The support frame is attached to the capturing frame and provides a base allowing the capturing structure to be disposed on the ground. Other existing capturing structures can be integrated into a playing surface, for example volleyball nets. Existing volleyball nets can include opposing posts and a net hung between the two posts, where players train in hitting balls over the net within a playing surface.

A disadvantage of such structures is that they cannot be easily collapsed and efficiently stored. This is because both the support frame and the capturing frame must be properly folded and placed in a container. Further use of a capturing frame and a supporting frame makes such structures more expensive to manufacture and harder to carry due to increased weight.

There are portable ball net structures available, and they tend to have members that are formed of a single continuous piece or formed from numerous smaller pieces. A disadvantage of net structures formed of a single continuous piece is that they cannot be easily collapsed and efficiently stored due in part to its size. For example, a portable soccer goal can be formed of a single continuous frame wherein wheels are attached to a base to allow the soccer goal to be transported or wheeled out to a desired location. Although portable, transporting or positioning the soccer goal can be cumbersome, especially if the soccer goal is a regulation sized goal.

Portable goals formed of numerous pieces are more likely to be collapsible and easy transport, but have the distinct disadvantage of being difficult and slow to set up, and not made of robust materials. For instance, loose fasteners may require tools for driving or tightening, and may also become lost in transit or storage or during assembly of the goal on the playing surface. Additionally, collapsible goals or nets may have components that are attached using lockable hinges. The hinges on such goals or nets typically require a locking device to hold the frame of the goal or net in a stable and locked position. These locking devices can malfunction or break due to repeated strikes from a ball, bat, kicks from users while using the net, and the like. As such, the locking device would be inoperable and would not be able to lock the components at the hinge, such that the hinge would be ineffective at holding the support frame of the goal; thereby rendering the goal inoperable. Some volleyball net structures require volleyball posts that are inserted into an opening in the ground of playing surface, such that the posts can be removed. However, conventional volleyball posts can be heavy and difficult to easily transport. Furthermore, the opening in the ground that receives the volleyball post is typically configured to only receive a certain sized post. Lastly, any damage to the opening in the ground could prevent the post from being received and not allow for the volleyball net to be assembled.

The above frame structures are typically configured for a single configuration and net, such that the frame is fixed and cannot be configured into a different arrangement for a different net and/or a different sports-related activity. For example, the portable soccer goal formed of a single continuous frame cannot be modified into a differently configured frame for a different net because the single continuous frame is permanently fixed and only designed to be used with a soccer goal net. In addition, frames formed of multiple pieces can only be assembled in the designed single configuration and is not customizable. Also, volleyball posts that are inserted into an opening in the ground or playing surface are only designed to be used with volleyball nets. The spacing of the holes in the ground restricts the type of net that can be used with the volleyball posts, and cannot be customized or rearranged to use with a different net.

The disclosure is a sports skills training apparatus that is portable, collapsible, and able to be configured into different arrangements for different nets and/or different sports-related activities. For example, the sports skills training apparatus can be configured to receive nets of different sizes and/or configurations that are designed for different sports and/or different sports-related activities. The sports skills training apparatus can also be configured to alter its dimensions to be used for different sports-related activities and/or to receive different nets. The disclosure addresses these needs and provides further related advantages.

SUMMARY

The disclosure disclosed herein provides various aspects of a sports skills training apparatus that are cost effective, easy to assemble/disassemble, easily transportable and provide the required structural support to receive or capture a projectile such as but not limited to a soccer ball, baseball, or volleyball. The different aspects comprise elements to allow the training apparatus to be configured into different arrangements, such that the apparatus can be used with a different net and/or a different sports-related activity. The training apparatus is configured to be collapsible, easy to transport between locations and yet provide a sufficiently sized net to allow for sports practice or training, such as but not limited to soccer, baseball, or volleyball. The disclosure is also configured such that the training apparatus can be easily assembled or disassembled by a single individual.

In one aspect of the disclosure, as broadly described herein, a ball net structure comprises a base structure including at least one support portion, at least one base extension, and a hinge, wherein the at least one support portion is coupled to the at least one base extension and the hinge. At least one rod is removably coupled to the base structure and received by a net, wherein the net is adapted to exert a pulling force on the at least one rod such that the at least one rod exerts a force onto said hinge in order to lock the at least one support portion in place.

In another aspect of the disclosure, the ball net structure comprises a base structure comprising first and second support portions pivotally attached to a hinge, a plurality of rods coupled to the base structure, and a net received by one or more of the plurality of rods, wherein the rods are configured to exert a force on the hinge in order to prevent rotation of the first and second support portions. The base structure, rods and net, when fully deployed, are adapted to withstand the force of a ball or projectile so as to capture the ball and to maintain the net apparatus in an upright position.

In another aspect of the disclosure, a ball net structure comprises a base structure comprising a first support portion, a first base extension, and a first base extension hinge, wherein the first support portion and base extension are coupled to the first base extension hinge, a second support portion, a second base extension, and a second base extension hinge, wherein the second support portion and second base extension are coupled to the second base extension hinge. The first support portion is configured to receive the second support portion, wherein the second support portion comprises a locking pin that engages one of a plurality of openings in said first support portion to lock the first and second support portions together. The plurality of openings allows the positioning of second support portion within the first support portion to be adjustable. At least one rod is removably coupled to the base structure proximate at least one of the first and second base extension hinges, and is received by a net. The net is adapted to exert a pulling force on the at least one rod such that the at least one rod is in a flexed state. The adjustability of the second support portion within the first support portion allows the base structure to be arranged to be configured into different arrangements, such that the ball net structure can be used with different nets and/or attachments for different sports and/or different sports-related activities.

In another aspect of the disclosure, the ball net structure comprises a base structure comprising at least one support portion, at least one base extension, at least one base extension hinge, and a base hinge, wherein the at least one support portion is coupled to the at least one base extension hinge and the base hinge, and the at least one base extension is coupled to the at least one base extension hinge. At least one rod is removably coupled to the base structure and received by a net, wherein the net is adapted to exert a pulling force on the at least one rod such that the at least one rod exerts a torque force onto said base hinge in order to lock the at least one support portion in place.

In another aspect, as broadly disclosed herein, a sports skills training apparatus comprises a support portion having a first end and a second end, base poles pivotally coupled to the support portion at the first and second ends, base brackets coupled to the base poles opposite the support portion, extensions coupled to the base brackets, first and second flexible rods removably coupled to the support portion, and a net configured to be received by the flexible rods, wherein the net is adapted to exert a pulling force on the first and second flexible rods bending the rods from a linear state to an arcuate state, such that a net tension pulls the first rod into the arcuate state and simultaneously pulls the second rod into the arcuate state.

In another aspect, the sports skills training apparatus comprises a support portion having a first support portion, a second support portion and a support portion bracket, where the first and second support portions are coupled to support portion bracket such that the first support portion rotates about a first pivot of the support portion bracket and the second support portion rotates about a second pivot of the support portion bracket. A first bracket coupled to the first support portion and a second bracket coupled to the second support portion opposite the first bracket, first and second base poles coupled to a respective one of the first and second brackets, and base brackets coupled to a respective one of the first and second base poles, wherein at least one first extension is coupled to a first base bracket and at least one second extension is coupled to a second base bracket. First and second flexible rods removable coupled to the support portion, wherein a net is configured to be received by the first and second rods, wherein the first and second flexible rods exert a force onto the support portion bracket to secure the first support portion and the second support portion in an open position within the support portion bracket, wherein the net bends the first and second flexible rods from a straight relaxed state into a bow-shaped flexed state.

In another aspect, the sports skills training apparatus comprises a support portion having a first end and a second end, a first bracket coupled to the first end, a second bracket coupled to the second end, at least one first extension pivotally coupled to the first bracket, at least one second extension pivotally coupled to the second bracket, a support portion bracket between the first and second ends of the support portion wherein the first and second ends of the support portion can be pivoted about a respective pivot of the support portion bracket such that the first and second ends can be positioned in an opened end or a closed end. First and second flexible rods removably coupled to the support portion proximate the first and second ends of the support portion, wherein a net is configured to be received by the first and second rods such that the first and second flexible rods exert a force onto the support portion bracket to secure the first and second ends of the support portion at the opened ends within the support portion bracket.

This has outlined, rather broadly, the features and technical advantages of the disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

FIG. 2*c* is another side view of the hinge according to an aspect of the disclosure.

FIG. 3 is a perspective view of a base structure according to an aspect of the disclosure.

FIG. 9 is another top plan view of the base structure of FIG. 6.

FIG. 10 is a perspective view of a base extension hinge according to an aspect of the disclosure.

FIG. 16 is a side view of a base structure according to an aspect of the disclosure.

FIG. 17 is an enlarged side view of a base extension hinge according to an aspect of the disclosure.

FIG. 26 is another partial enlarged view of the sports skills training apparatus of FIG. 22.

FIG. 27 is a perspective view of an aspect of a sports skills training apparatus according to an aspect of the disclosure.

FIG. 29 is another partial enlarged view the sports skills training apparatus of FIG. 27.

FIG. 30 is a perspective view of an aspect of a sport skills training apparatus according to an aspect of the disclosure.

DETAILED DESCRIPTION

Figure 1:
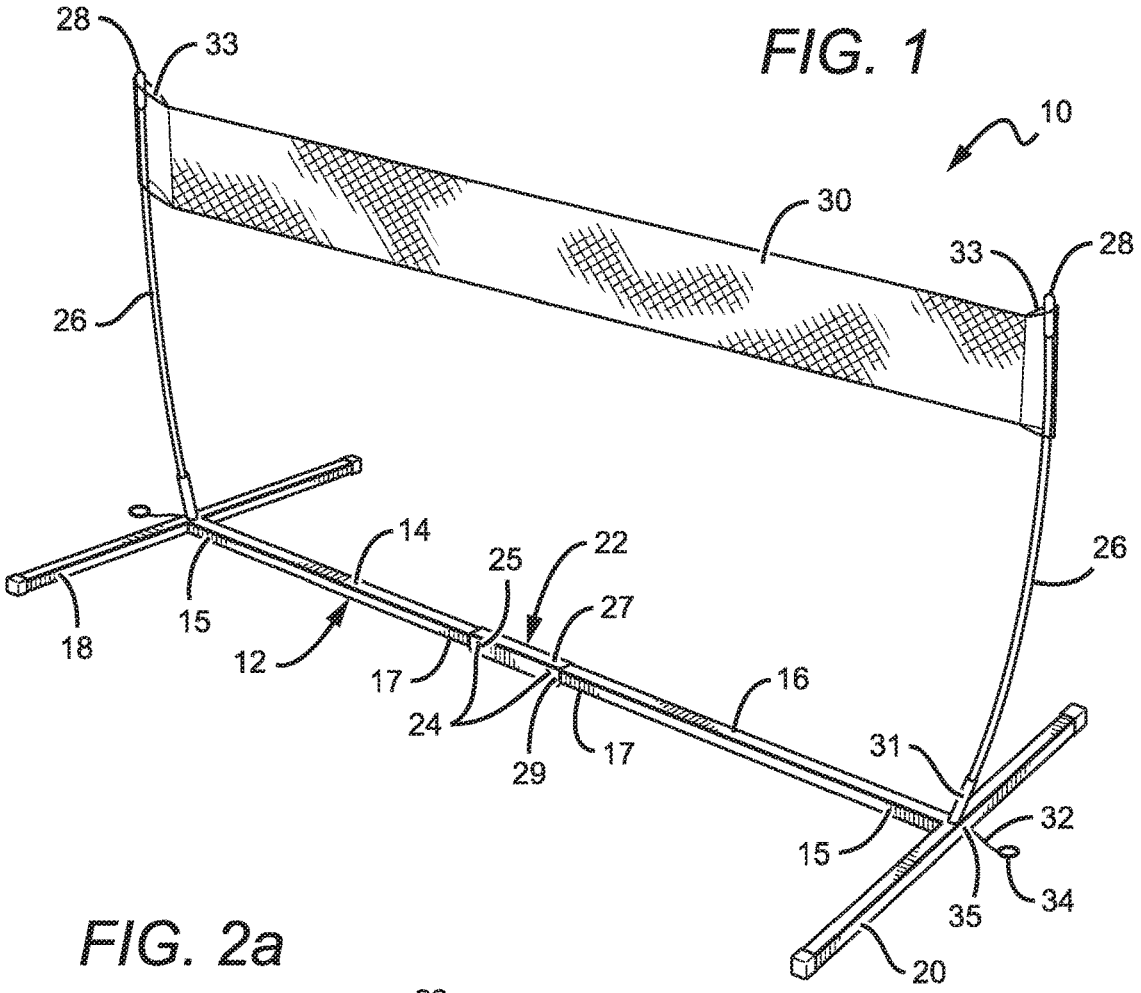
FIG. 1 is a perspective view of a ball net structure according to an aspect of the disclosure.

The disclosure described herein is directed to different aspects of a sports skills training apparatus and/or a ball net structure that in some aspects provides a net apparatus that is easy to setup and is collapsible such that the net apparatus is easy to assemble by a single individual, store, is portable, and is customizable for different nets and/or sports-related activities. The net apparatus can comprise many different materials and can be used in many different applications such as, but not limited to, practicing soccer skills, throwing and/or hitting baseballs, or practicing volleyball skills. The sports skills training apparatus according to the present disclosure can be arranged in many different ways with many different components, and is generally arranged to provide a net structure to capture or catch a projectile, or provide a net or obstacle that a game ball could travel over to assist players in improving their skills in striking the game ball over the net or obstacle. The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The ball net structure can comprise many different materials and can be used in many different applications such as, but not limited to, practicing soccer skills, throwing and/or hitting baseballs. The ball net structure according to the disclosure can be arranged in many different ways with many different components, and is generally arranged to provide a net structure to capture or catch a projectile. In one aspect, as broadly described herein, a ball net structure comprises a base structure comprising at least one support portion and at least one base extension. The ball net structure further comprises a hinge, wherein the at least one support portion is coupled to the at least one base extension and the hinge. At least one rod is removably coupled to the base structure and is adapted to be received by a net. The net is adapted to exert a pulling force on the at least one rod causing the at least one rod to exert a torque force onto said hinge, whereby the at least one support portion is locked into place. In other aspects of the disclosure, the ball net structure comprises a base structure comprising a first support portion and a second support portion, wherein the first and second support portions are attached to a hinge, such that the first and second support portions are opposite each other and the hinge is interposed therebetween. At least one rod is removably received by the base structure, wherein a net is adapted to receive the at least one rod. The ball net structure further comprises a first base extension coupled to the first support portion and a second base extension coupled to the second support portion. The first and second base extensions are adapted to further support the load of the ball net structure and allow the ball net structure to remain upright while in use. In some aspects, the ball net structure can also comprise an attachment device proximate the base structure, such that the attachment device is adapted to receive an attachment cord that is adapted to receive a weighted device or force resistance device to provide additional structural support. The attachment device can also be configured to receive part of the net. In some aspects, the attachment device can be on at least one base extension, at least one support portion, the hinge, or a combination thereof. At least one advantage of the ball net structure is that the ball net structure is configured to exert a force on the hinge so as to maintain the ball net structure in an upright state when deployed. This arrangement allows the hinge to remain in a fixed state without the need of one or more locking devices to lock the support portion to the hinge.

In another aspect, the ball net structure comprises a base structure comprising a first support portion, a first base extension, and a first base extension hinge, wherein the first support portion and first base extension are coupled to the first base extension hinge. The base structure can comprise a second support portion, a second base extension, and a second base extension hinge, wherein the second support portion and second base extension are coupled to the second base extension hinge. The first support portion is configured to receive the second support portion, wherein the second support portion comprises a locking pin that engages one of a plurality of openings in said first support portion to lock the first and second support portions together. At least one rod is removably coupled to the base structure and is received by a net. The net is adapted to exert a pulling force on the at least one rod such that the at least one rod is bent in a flexed state. The first and second base extensions are adapted to support the load of the ball net structure and allow the ball net structure to remain upright while in use. In some aspects, the ball net structure can also comprise at least one attachment device on the base structure, such that the at least one attachment device is adapted to receive an attachment clip which is adapted to provide additional structural support. The at least one attachment device can also be configured to receive part of the net. In some aspects, the at least one attachment device can be on at least one support portion, at least one base extension, at least one base extension hinge, or a combination thereof.

In one aspect, as broadly described herein, a sports skills training apparatus comprises a support portion having a first end and a second end, base poles pivotally coupled to the support portion at the first and second ends, base brackets coupled to the base poles opposite the support portion, extensions coupled to the base brackets, first and second flexible rods removably coupled to the support portion, and a net configured to be received by the flexible rods, wherein the net is adapted to exert a pulling force on the first and second flexible rods bending the rods from a linear state to an arcuate state, such that a net tension pulls the first rod into the arcuate state and simultaneously pulls the second rod into the arcuate state. In some aspects, the training apparatus comprises a support portion having a first support portion, a second support portion and a support portion bracket, wherein the first and second support portions are coupled to the support portion bracket such that the first support portion rotates about a first pivot of the support portion bracket and the second support portion rotates about a second pivot of the support portion bracket. A first bracket coupled to the first support portion and a second bracket coupled to the second support portion opposite the first bracket, first and second base poles coupled to a respective one of the first and second brackets, and base brackets coupled to a respective one of the first and second base poles, wherein a first extension is coupled to a first base bracket and a second extension is coupled to a second base bracket. First and second flexible rods removably coupled to the support portion, wherein a net is configured to be received by the first and second rods, wherein the first and second flexible rods exert a force onto the support portion bracket to secure the first support portion and the second support portion in an open position within the support portion bracket, wherein the net bends the first and second flexible rods from a straight relaxed state into a bow-shaped flexed state. The extensions are adapted to support the load of the training apparatus and allow the training apparatus to remain upright while in use. In some aspects, the sports skills training apparatus comprises a support portion having a first end and a second end, a first bracket coupled to the first end, a second bracket coupled to the second end, at least one first extension pivotally coupled to the first bracket, at least one second extension pivotally coupled to the second bracket, a support portion bracket between the first and second ends of the support portion wherein the first and second ends of the support portion can be pivoted about a respective pivot of the support portion bracket such that the first and second ends can be positioned in an opened end or a closed end. First and second flexible rods removably coupled to the support portion proximate the first and second ends of the support portion, wherein a net is configured to be received by the first and second rods such that the first and second flexible rods exert a force onto the support portion bracket to secure the first and second ends of the support portion at the opened ends within the support portion bracket. In some aspects, the training apparatus can also comprise an attachment device proximate the extensions, such that the attachment device is adapted to receive an attachment clip which is adapted to provide additional structural support. The attachment device can also be configured to receive part of the net. An advantage of the training apparatus is that the training apparatus is configured to exert a force on the support portion bracket so as to maintain the training apparatus in an upright state when deployed. This arrangement allows the support portion bracket to remain in a fixed state without the need of one or more locking devices to lock the support portion to the support portion bracket.

In some aspects, the training apparatus comprises a support portion comprising a first support portion and a second support portion coupled to a support portion bracket, wherein the first and second support portion are adapted to pivot with respect to the support portion bracket. The first and second support portions can be telescopic support portions such that each can comprise a plurality of portions that are adjustable such that the size of the first and/or second support portion can be increased and/or decreased. First and second flexible rods are removably coupled to the support portion and are adapted to receive a net. First and second extensions are coupled to the support portion and are configured to support the load of the training apparatus and allow the training apparatus to remain upright while in use.

The ball net structure and/or training apparatus of the disclosure can provide a number of additional advantages beyond those mentioned above. For example, the hinge and/or support portion bracket allows for ease of assembly/disassembly and storage of the ball net structure because the hinge and/or support portion bracket does not have a locking device that needs to be forcibly engaged and/or disengaged. The support portions coupled to the support portion bracket are held in a locked position by at least the forces exerted by the flexible rods onto the support portion. Removal of the net from the flexible rods allows the training apparatus to be collapsible, such that the training apparatus can be folded upon itself and form a smaller package that can easily be transported and/or stored without taking up too much physical space. Another advantage of the disclosure is that at least the first bracket, base bracket, or support portion bracket are configured to withstand the forces imparted by a ball, projectile, bat, and/or forces from users, such as kicks, that occur during use, in order to improve the durability and/or stability of the training apparatus. Yet another advantage is that the support portion can be at least partially elevated from the surface that the training apparatus is on, which assists in preventing the support portion from being struck, damaged or hit by users, sporting balls or the like. In some aspects, the support portion can be at least partially elevated by the extensions. In some aspects, the support portion can be at least partially elevated by the base poles. In some aspects, the elevation of the support portion can be adjusted by adjusting at least the base poles, while in some aspects, the elevation of the support portion can be adjusted by adjusting the base poles and a support portion leg. In some aspects, adjusting the elevation of the support portion can allow the training apparatus to be at different heights. This allows the training apparatus to be utilized by various aged users and various skill levels.

Another advantage of the disclosure is that the ball net structure is collapsible such that the ball net structure can be folded upon itself and form a smaller package that can easily be transported and/or stored without taking up too much physical space. At least another advantage of the disclosure is that the first support portion and/or the second support portion allows the base structure to alter its shape and/or size such that nets of different sizes can be used with the ball net structure and/or training apparatus. Additionally, nets of different sizes and/or configurations can be used with the ball net structure and/or training apparatus, due in part to the adjustability of the base structure. The ability to use nets that are differently sized and/or differently configured with the ball net structure allows various training exercises and/or sports-related activities to be performed with the ball net structure and/or the training apparatus.

The ball net structure and/or training apparatus of the disclosure can be used to stop or capture a ball or the like, or provide a net that a ball can travel over or under when performing sports-related activities. However, the disclosure is not intended to be limited to such aspects. As further described below, the ball net structure and/or training apparatus can be arranged to allow an individual to easily deploy and disassemble the ball net structure and/or training apparatus in an outdoor or indoor setting.

The disclosure is described herein with reference to certain aspects, but it is understood that the disclosure can be embodied in many different forms and should not be construed as limited to the aspects set forth herein. In particular, the disclosure is described below in regards to a ball net structure and/or a training apparatus to practice or perform sports-related activities in an outdoor setting, but it is understood that the disclosure can be used for many other applications in many different settings. The components of the ball net structure and/or training apparatus can have different shapes and sizes beyond those shown in the figures or discussed herein. The terms ball net structure and training apparatus can be used interchangeably herein, such that discussions of the ball net structure are applicable to the training apparatus and discussions of the training apparatus are applicable to the ball net structure.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the disclosure can be arranged in many different ways with many more features and elements beyond what is shown in the figures.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Aspects of the disclosure are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the disclosure.

Figure 2A:
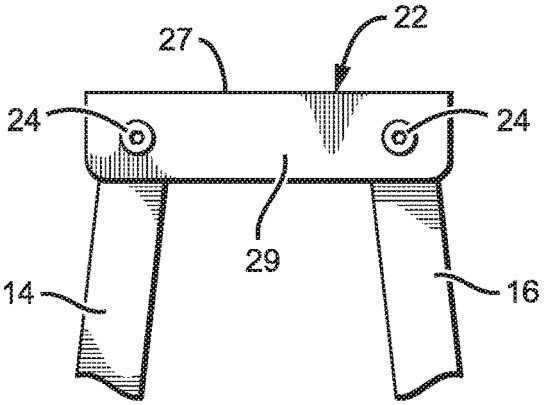
FIG. 2*a* is a side view of a hinge according to an aspect of the disclosure.
Figure 2B:
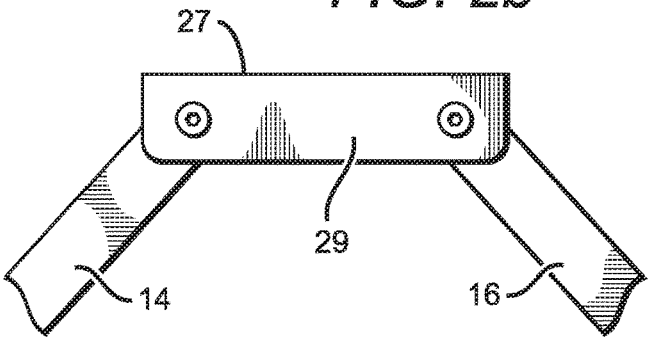
FIG. 2*b* is another side view of the hinge according to an aspect of the disclosure.

FIGS. 1-2*c* show one aspect of a ball net structure 10 according to an aspect of the disclosure. In some aspects, the ball net structure 10 is configured such that the ball net structure 10 can be deployed in an outdoor setting such as, but not limited to, a natural grass, synthetic field, dirt, concrete or the like. In other aspects, the ball net structure 10 can be deployed in an indoor setting such as but not limited to an indoor training facility, residential or commercial setting having a synthetic or natural surface, or the like. The ball net structure 10 can be used in sports-related activities, such as but not limited to baseball, softball, soccer, football and the like. The ball net structure 10 can also be used to allow users to practice kicking, hitting or throwing a ball or other projectile to the ball net structure 10, such that the ball net structure captures or catches the ball so that the user does not have to travel great distances to retrieve the ball. The ball net structure 10 comprises a base structure 12 comprising first and second support portions 14, 16 pivotally attached to a hinge 22, a plurality of rods 26 removably coupled to the base structure 12, and a net 30 adapted to receive the plurality of rods 26. The aspect shown in FIG. 1 has two rods 26, but other aspects can have more than two rods 26. The rods 26 are configured to exert a force on the hinge 22 in order to lock the first and second support portions 14, 16 in place and prevent rotation of the first and second portions 14, 16 about the hinge 22. The base structure 12, rods 26 and net 30, when fully assembled and deployed, are adapted to withstand the force of a ball or projectile so as to capture the ball while keeping the ball net structure 10 in an upright position.

For the same or similar elements or features, the reference numbers from FIGS. 1-2*c* may be used throughout the application herein. In one aspect of the disclosure, the base structure 12 can comprise a first base extension 18 coupled to the first support portion 14 and a second base extension 20 coupled to the second support portion 16. This arrangement allows the first and second base extensions 18, 20 to provide additional structural support to further stabilize the ball net structure 10 in an upright position. In some aspects, the first and second base extensions 18, 20 can be coupled to the respective support portions 14, 16 such that the first and second base extensions 18, 20 are perpendicular to the respective support portion 14, 16. In other aspects, the first and second base extensions 18, 20 can be angled in a V-shaped configuration and configured to raise the base structure 12 above the ground or surface or allow the base structure 12 to contact the ground or surface, wherein the angle of the V-shaped base extensions 18, 20 can be in the range of 90°-140° (degrees). In yet other aspects, as in FIG. 3, a base extension 55 comprises a base extension hinge 50 coupled to the support portions 16 and 14 (not shown), first and second base extension legs 52, 54 pivotally attached to the base extension hinge 50 about a respective pivot point 51, and can be locked into place by respective locking pins/buttons 53. In this arrangement, the legs 52, 54 can be released from their respective locking pins/buttons 53 and are able to rotate about pivot points 51 towards the support portions 16 and 14 such that the base structure 56 is further collapsible and easy to transport. In the aspect of FIG. 1, the base extensions 18, 20 are stationary and are not able to be rotated towards their respective support portion 14, 16. Additionally, the first and second legs 52, 54, in FIG. 3 can be arranged either bent, curved, or straight, such that the base structure 56 is elevated off the ground or surface. However, in other aspects, the legs 52, 54 can be arranged to allow the base structure 56 to contact the ground or surface. The legs 52, 54 can also comprise the attachment device 33, attachment cord 32 and ring 34 as discussed in the aspect of FIG. 1.

The first and second support portions 14, 16 each have a first end 15 and a second end 17, wherein the first end 15 of each of the support portions 14, 16 is coupled to the respective base extensions 18, 20. The first and second support portions 14, 16 extend from the respective base extensions 18, 20 towards a hinge 22 and are pivotally coupled to the hinge 22, such that the base extensions 18, 20 are opposite the hinge 22. The second ends 17 of support portions 14, 16 are coupled to the hinge 22 using hinge pins 24. The hinge 22 has openings 25 that receive the hinge pins 24 so as to couple the support portions 14, 16 to the hinge 22. In one aspect, the hinge pins 24 can be screws with a nut to hold the screw in place. However, in other aspects, the openings 25 of the hinge 22 can be threaded to receive the hinge pins 24, or the hinge pins can be nails, rivets or the like. The support portions 14, 16 can be coupled to the hinge 22 using various known means in the art and is not intended to be limited to the aspects disclosed herein. The first and second support portions 14, 16 can be made of many different materials known in the art, such as but not limited to wood, plastic, metal, a composition thereof or the like. The first and second support portions 14, 16 can be formed to have many different shapes, such as but not limited to circular, square, polygonal, a combination thereof or the like. The first and second portions 14, 16 of the aspect of FIGS. 1-2*c* are shown as having a square-like shape.

The hinge 22 is arranged to receive at least a portion of the first and second support portions 14, 16 such that the support portions 14, 16 are able to rotate about the respective hinge pin 24. In one aspect, the hinge 22 is configured to be a U-shaped channel having a hinge base 27, sidewalls 29 and openings 25 to allow respective hinge pins 24 to be received by the hinge 22 as well as the first and second support portions 14, 16, such that the first and second support portions 14, 16 are pivotally coupled to hinge 22. In the aspect of FIG. 1, the second ends 17 of each of the first and second support portions 14, 16 are pivotally coupled to the hinge 22. However, in other aspects, the first and second support portions 14, 16 can be pivotally coupled to the hinge 22 at different locations between the first and second ends 15, 17.

An advantage of the disclosure is that in some aspects the hinge 22 can be U-shaped which allows the hinge 22 to hold the first and second support portions 14, 16 in a stable and parallel position along the same axis and also provides a physical stop which prevents the first and second support portions 14, 16 from pivoting beyond the physical stop. However, in other aspects, the hinge 22 can be shaped in different forms such that the support portions 14, 16 are not aligned along the same axis, can be parallel or non-parallel, yet still provide a physical stop to prevent the portions 14, 16 from rotating beyond the physical stop.

As shown in FIGS. 1-2*c*, the first and second portions 14, 16 are coupled to the hinge 22, using hinge pins 24, such that they rotate about the respective hinge pin 24. Rotation of the first support portion 14, in a direction opposite the second support portion 16, about the hinge pin 24 will stop when the first support portion 14 comes into contact with the hinge base 27 of the hinge 22; FIG. 2*c* shows an example of the support portions 14, 16 in contact with the hinge base 27 and precluding further rotation. The hinge base 27 provides a physical stop and prevents the first support portion 14 from further rotation. The second support portion 16 is similarly configured as the first support portion 14 and will stop rotating about hinge pin 24 when the second support portion 16 contacts the hinge base 27. The physical stop provided by the hinge 22 properly aligns the first and second support portions 14, 16 when assembling the ball net structure 10. Yet another advantage of the disclosure is that the hinge 22 allows the base structure 12 to be folded onto itself so that the ball net structure 10 can be easily stored as well as easy to transport. This arrangement allows the base structure 12 to reduce its size and/or area, thereby allowing the ball net structure 10 to be stored in a small container.

When assembling the ball net structure 10, the first and second support portions 14, 16 of the base structure 12 are rotated away from the opposite support portion 16, 14 towards the hinge base 27. When the support portions 14, 16 are in contact with the hinge base 27, precluding further rotation, the base structure 12 is ready to be placed on the playing surface, such as but not limited to a natural grass, synthetic filed, cement, wood, asphalt, or the like. The base structure 12 is placed on the playing surface such that the hinge base 27 is opposite the playing surface. In other words, the hinge base 27 does not contact the surface upon which the base structure 12 is positioned on. The hinge 22 can be arranged in many different configurations and is not intended to be limited to the aspects presented herein. In some aspects, the hinge 22 can be configured such that the hinge base 27 is proximate the playing surface, in a plane that is parallel to the playing surface, in a plane that is perpendicular to the playing surface, or in a plane that could intersect the playing surface, and/or a combination thereof. At this point, the at least one rod 26 is ready to be installed.

The base structure 12 is further adapted to receive the at least one rod 26. In one aspect, the base structure 12 comprises at least one shaft 31 extending substantially vertically and configured to receive one of the at least one rod 26. In another aspect, the base structure 12 comprises a plurality of shafts 31, wherein each respective shaft 31 is adapted to receive a respective one of the at least one rod 26. In the aspect of FIG. 1, the base structure 12 comprises two shafts 31, with one shaft 31 coupled to the first base extension 18 and another shaft 31 coupled to the second base extension 20. As shown in FIG. 1, each of the shafts 31 are coupled to a respective base extension 18, 20 proximate the first end 15 of the first and second support portions 14, 16. However, the shafts can be positioned at various locations and is not intended to be limited to the aspect of FIG. 1. In some aspects, the shaft 31 can be positioned at the base extension, the support portion, the hinge, the base extension hinge, and/or a combination thereof. In yet other aspects, the base structure 12 can comprise more than two shafts 31 for aspects that comprise more than two rods 26. The number of shafts 31 present will be equal to the number of rods 26. However, is some aspects, the number of shafts present does not need to equal the number of rods, such that there could be some shafts unused and not receiving of a rod, based on the configuration of the deployed net apparatus.

The at least one rods 26 are configured to be securely held within the shaft 31, such that the shaft 31 maintains a stable structural connection between the shaft 31 and the at least one rods 26 and prevents the rod 26 from being removed from the shaft 31 when the ball net structure 10 is assembled. In one aspect of the disclosure, the shaft 31 is similarly shaped as the rod 26, such as but not limited to cylindrically shaped, and is slightly larger than the rod 26 such that the rod 26 can easily be received by the shaft 31. The shaft 31 can further comprise a sheath contacting the inner wall of the shaft 31 that receives the rod 26. The sheath is adapted to protect the rod 26 within the shaft 31 from forces exerted on the rod 26 when the ball net structure 10 is fully assembled. As will be discussed below, upon assembly of the ball net structure 10, the rods 26 experience a moment force at the point where the rod 26 is received by the shaft 31, and causes the rod 26 to exert a compression force upon the sheath. The sheath thereby protects the rod 26 from the forces exerted on and/or by the rod 26.

In some aspects, the shaft 31 can be shaped such that the radius of the shaft 31 decreases the further the rod 26 is inserted into the shaft 31. In this arrangement, the shaft 31 uses a compression force to form the structural connection between the shaft 31 and the rod 26. In other aspects, mechanical devices, such as but not limited to, screws, nuts, nails, rivets or the like, can be used to form the structural connection so as to securely attach the rod 26 to the shaft 31. In yet other aspects, the rods 26 can be configured to have an attachment means such that the rods 26 can be attached to the shaft 31; non-limiting examples of such attachment means are the rods 26 being threaded and screwed into the shaft 31 or the rod 26 and shaft 31 configured similarly like a bayonet-type locking device.

In the aspect of FIG. 1, the rods 26 are circularly shaped and the shaft 31 is also correspondingly circularly shaped to receive the rod 26. The shape of the rod 26 and shaft 31 is not intended to be limited to a circular shape, other shapes such as quadrilateral, triangular, or any other polygonal shape can be used. The shaft 31 can also be similarly shaped as the rod 26, but in some aspects, the shaft 31 can be shaped differently than the rod 26. The rods 26 can be made of many different materials known in the art, such as but not limited to fiberglass or carbon fiber, such that the rods 26 are flexible, elastic, capable of returning to an initial form or state after deformation, and able to withstand the impact forces applied by sports-related balls and/or other projectiles that can be captured or caught by the ball net structure 10, or thrown, kicked, and/or hit towards the ball net structure 10.

The rods 26, when received by the shaft 31 flare outwards, such that the rods 26 are in a relaxed state and are substantially straight. A net 30 comprising at least one sleeve 33 is arranged to receive the at least one rod 26 and is adapted to exert a force on the at least one rod 26 bending the at least one rod 26 into a flexed state. Inserting the at least one rod 26 into the sleeve 33 results in the at least one rod 26 being bent from the relaxed state into a flexed state. As shown in FIG. 1, when both rods 26 are received by the respective shaft 31 and the net 30, both rods 26 are bent inwards towards the opposing rod and into the flexed state. Removal of the net 30 allows the rods 26 to return to their original form of the relaxed state. Repeated use of the ball net structure 10 does not result in the rods 26 being permanently bent in a shape similar to that of the flexed state. The net 30 can be easily installed and removed by a single individual.

The net 30 imparts a pulling force on each of the rods 26 which causes each of the rods 26 to bend in a direction towards the hinge 22. Once bent towards the hinge 22, the rods 26 are in the flexed state and experience a moment force about its pivot point. The pivot point of each of the rods 26 corresponds to the point at which the rods 26 are received by the shaft 31. The moment force experienced by the rods 26 is imparted onto the hinge 22 and the first and second support portions 14, 16 of the base structure 12, with the transferred force being greatest at the hinge 22. This transferred force further assists in locking the hinge 22 and base structure 12, such that the first and second support portions 14, 16 are locked into place.

An advantage of the disclosure is that the force exerted onto the rods 26 by the net 30 results in a torque force experienced by the rods 26 and transferred to the hinge 22, which allows the hinge 22 to lock the first and second support portions 14, 16 into place without the need of a locking device such as a locking clip or button. The absence of such a locking device on the hinge 22 prolongs the lifetime of the ball net structure 10 due, in part, to the hinge 22 not deteriorating or breaking down due to failure or malfunctioning of the locking clip or button.

Figure 4:
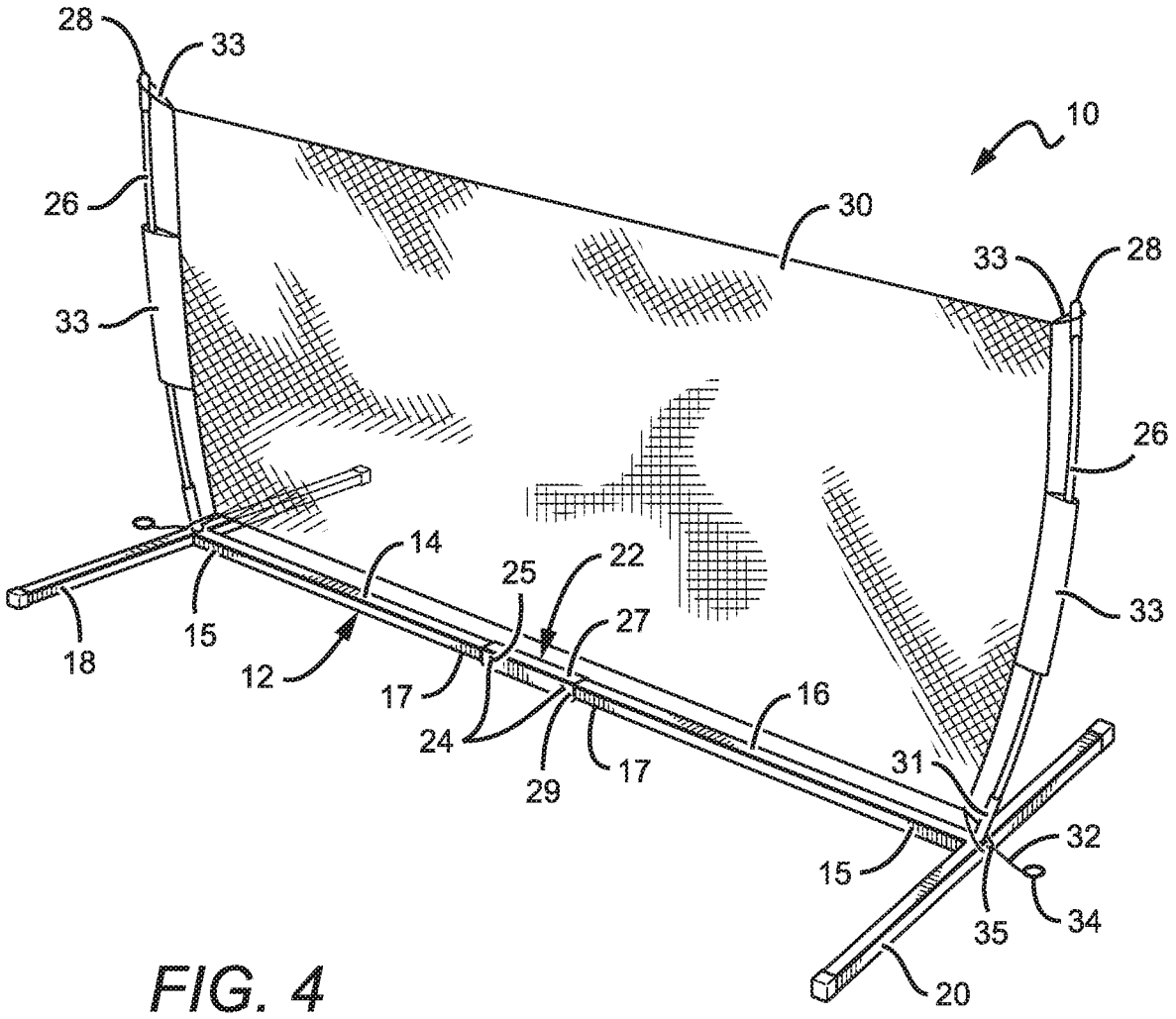
FIG. 4 is a perspective view of a ball net structure according to an aspect of the disclosure.

The net 30 can be a mesh surface or any typical net known in the art. The net comprises at least one sleeve 33 adapted to receive the rod 26 so as to mount the net 30 onto the rods 26. The aspect of FIG. 1 shows the net 30 having a sleeve 33 in the form of a plurality of loops that receive the rods 26. However, in some aspects, such as FIG. 4, the net 30 comprises a plurality of sleeves 33 wherein at least one of the plurality of sleeves 33 receives the base structure 12, in order to provide additional structural support for the ball net structure 10. The sleeve 33 can be configured in many different ways, such as but not limited to a sleeve that spans the length of the rod, a plurality of smaller sleeves that are spaced apart from each other and run along the length of the rods 26, or a sleeve that spans along a partial length of the rods 26. In some aspects, each rod 26 comprises an endcap 28 opposite the portion of the rod 26 that is received by the shaft 31 and is configured to receive at least a portion of the sleeve 33, such that the endcap 28 prevents the sleeve 33 from coming off the rods 26 while the ball net structure 10 is assembled and/or in use. In some aspects, the endcaps 28 can have a tab that extends outward beyond the external shape of the rod 26 that prevents the net 30 from coming off the rod 26. However, in some aspects, the endcaps 28 can have other means of preventing the net 30 from coming off the rod 26, such as but not limited to a hook, loop, locking clip, or the like.

The ball net structure 10 according to the disclosure is designed to withstand the force of a ball or other projectile so as to catch or capture the ball, such that the ball net structure 10 maintains an upright standing position. In some aspects of the disclosure, the ball net structure 10 can comprise at least one attachment device 35 that can receive an attachment cord 32 having a ring 34. The attachment cord 32 allows for the connection of a weight, stake or similar device to provide additional support for the ball net structure 10. In the aspect of FIG. 1, the attachment device 35 is a loop-like device that is coupled to the base structure 12 and allows the attachment cord 32 to be tied or coupled to the attachment device 35. The attachment cord 32 can be a bungee cord, rope, or the like. The ring 34 allows for a weighted or force-resistant device (not shown), such as but not limited to a sandbag or a suction cup, to be attached to the base structure 12 to provide additional support for the ball net structure 10 and prevent the ball net structure 10 from moving, falling over, or shifting. The ring 34 can also be used to receive a stake, staple, hook or similar device that is inserted into the ground or surface so as to attach the ball net structure 10 to the ground or surface. In some aspects, the attachment cord 32 does not comprise the ring 34, and is still configured to receive the weighted or force-resistant device that would be received by the ring 34. In some aspects, the attachment cord 32 can be in a loop and/or circular configuration that allows connection to the attachment device 35 and receive the weighted or force-resistant device.

The attachment device 35 is configured to extend laterally or horizontally from the base structure 12, such that the weight or similar device attached to the cord 32 provides a lateral support, which prevents the ball net structure 10 from lifting upwards or shifting its position. In some aspects, the net 30 can be received by the attachment device 35, such that the sleeve 33 of the net 30 is coupled to the attachment device 35. The attachment device 35 allows for both the sleeve 33 and the cord 32 to be coupled to the attachment device 35. An advantage of this arrangement is that the weight or similar device attached to the attachment device 35 can also act as a shock absorber when a ball or projectile is caught or captured by the ball net structure 10. The force of the ball is distributed throughout the ball net structure 10 and also partially transferred to the weight or device attached to the attachment device 35, which further provides additional support to the ball net structure 10 which increases the stability and/or the force the ball net structure 10 can withstand. In some aspects, the ball net structure 10 comprises a plurality of attachment devices 35 and can be disposed on the base structure, the base extension, the base extension hinge and/or a combination thereof. The attachment device 35 can be arranged in many different configurations and is not intended to be limited to aspects disclosed herein. In some aspects, the attachment device 35 can be an extension extending from the base structure, base extension, hinge, base extension hinge, and/or a combination thereof. The attachment device 35 can receive the cord 32 and/or one of the sleeves of the net such that the cord and/or the sleeve is retained by the attachment device and held in place.

Figure 5:
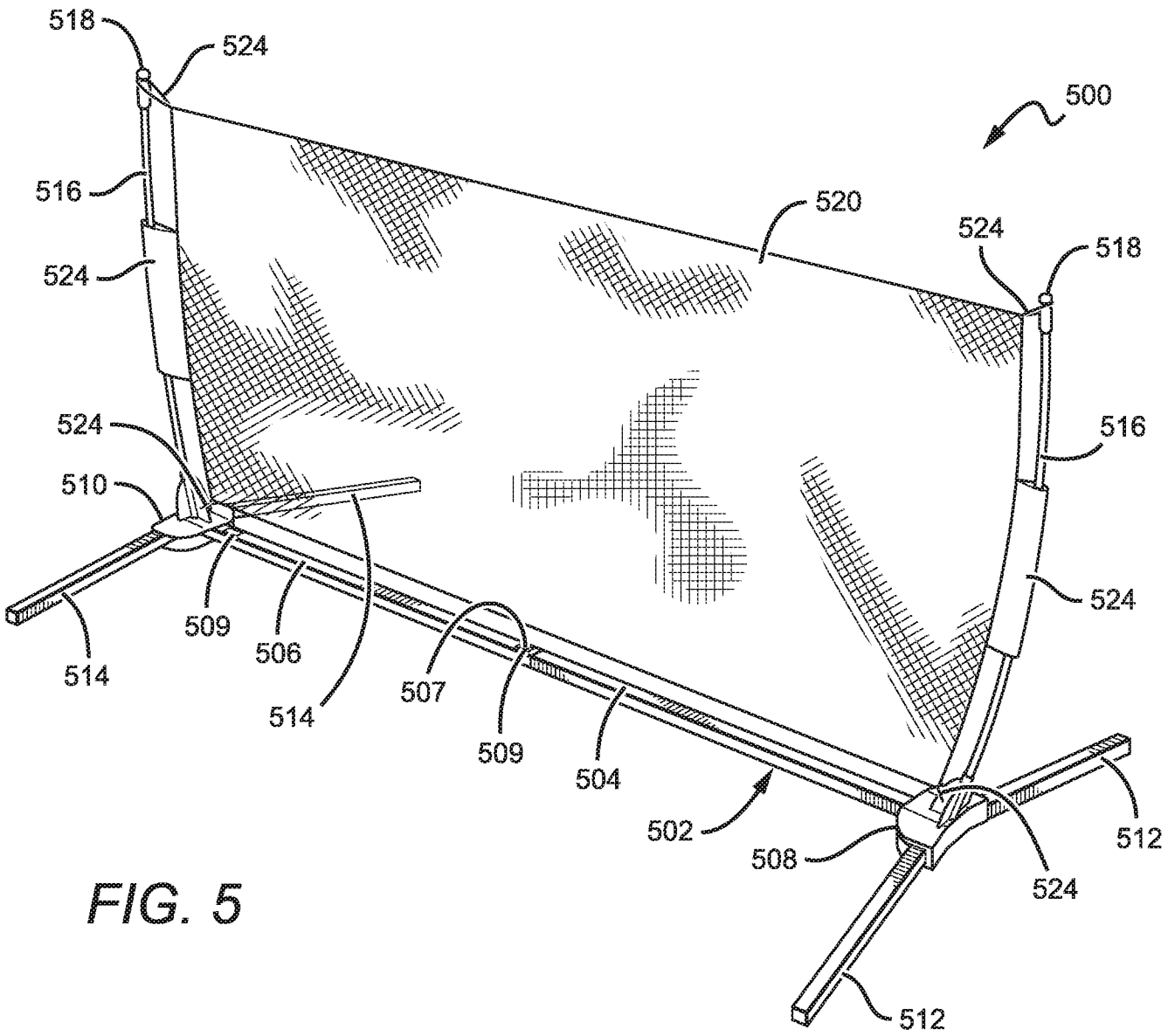
FIG. 5 is a perspective view of a ball net structure according to an aspect of the disclosure.
Figure 6:
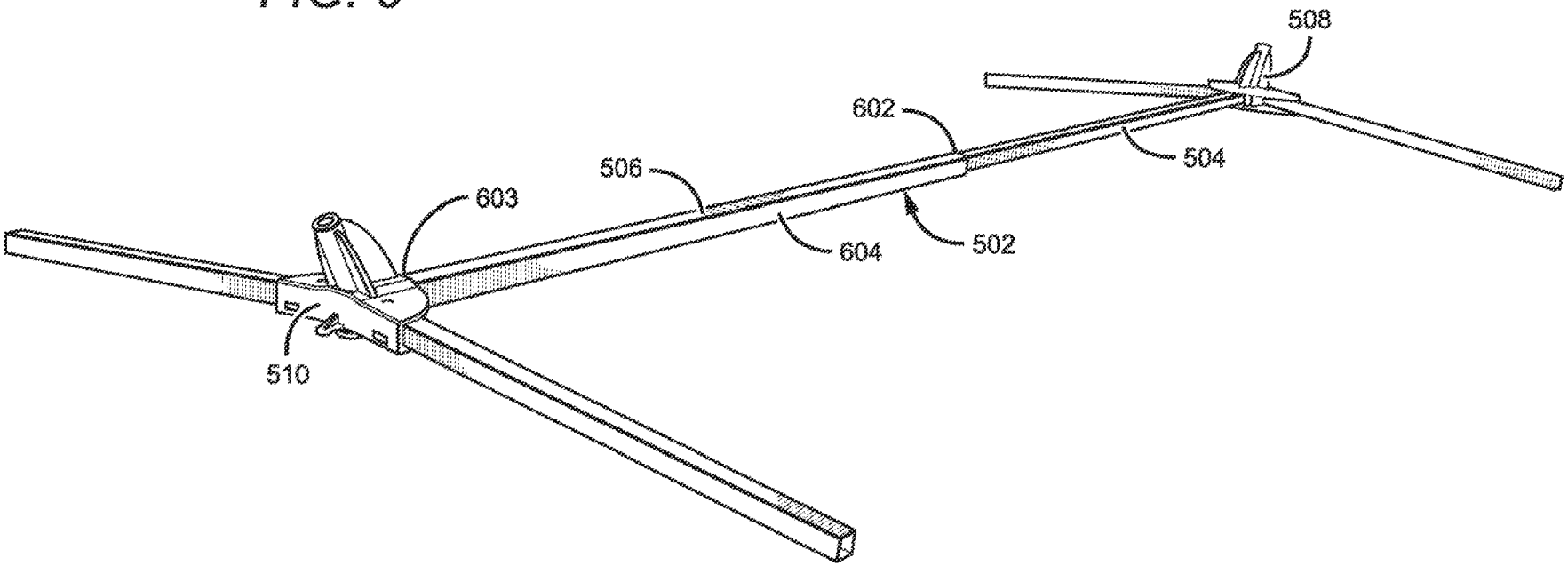
FIG. 6 is a perspective view of a base structure according to an aspect of the disclosure.

FIG. 5 shows one aspect of a ball net structure 500 according to the disclosure.

The ball net structure 500 comprises a base structure 502 comprising a first support portion 504, a first base extension 512, and a first base extension hinge 508, wherein the first support portion 504 and first base extension 512 are coupled to the first base extension hinge 508. The base structure 502 further comprises a second support portion 506, a second base extension 514, and a second base extension hinge 510, wherein the second support portion 506 and second base extension 514 are coupled to the second base extension hinge 510. The first support portion 504 is configured to receive the second support portion 506, such that the second support portion 506 is removably coupled to the first support portion 504. At least one rod 516 is removably coupled to the base structure 502 and is received by a net 520. The net 520 is adapted to exert a pulling force on the at least one rod 516 such that the at least one rod 516 is in a flexed state. The first and second base extensions 512, 514 are adapted to support the load of the ball net structure 500 and allow the ball net structure 500 to remain upright on a surface. The first and second base extensions 512, 514 absorb at least part of the load exerted onto the ball net structure 500 from a ball or other projectile when in use so as to maintain the ball net structure 500 in an upright position.

In one aspect, as shown in FIGS. 6-9, the first support portion 504 is configured to receive the second support portion 506, such that the second support portion 506 is removably coupled to the first support portion 504. In one aspect, the second support portion 506 can be hollow and comprise an open end 602 that allows part of the first support portion 504 to be at least partially inserted the open end 602 and at least partially received within the second support portion 506. In some aspects, the second support portion 506 can comprise a hollow cavity 604 extending from the open end 602 to an opposing end 603 of the second support portion 506 that is received by the second base extension hinge 510. In some aspects, the hollow cavity 604 can extend various lengths from the open end 602 and is not intended to be limited to the aspects disclosed herein. The second support portion 506 being hollow allows the positioning of the first support portion 504 within the second support portion 506 to be adjustable. In some aspects, the position of the first support portion 504 can be adjusted by sliding the first support portion 504 within the hollow cavity of the second support portion 506.

The position of the first support portion 504 within the second support portion 506 can be secured such that the first support portion 504 and second support portion 506 are coupled. In one aspect, the first support portion 504 comprises a locking pin 507 and the second support portion 506 comprises a plurality of openings 509, wherein the locking pin 507 engages one of the plurality of openings 509 to couple the first and second support portions 504, 506 together. The locking pin 507 securely fastens the first and second support portions 504, 506 and maintains the structural connection between the first and second support portions. In one aspect, the locking pin 507 can be a push button pin within the first support portion 504, wherein the push button pin is depressed to release the connection of the locking pin and the opening 509, allowing the first support portion 504 to be removably coupled to the second support portion 506. In other aspects, the locking pin 507 can be a pin that is external to the first support portion 504 that is inserted into one of the plurality of openings 509 to couple the first and second support portions 504, 506. In such aspect, the first and second support portion 504, 506 can comprise a plurality of openings 509 wherein the pin is inserted into aligned openings 509 of the first and second support portions 504, 506 to couple the first and second support portions 504, 506. In other aspects, the locking pin can be a screw, stake, or the like. The disclosure is not intended to be limited to a locking pin, and can be configured in many different ways, such that the second support portion and the first support portion are coupled.

The first and second support portions 504, 506 can be configured in many different ways and are not intended to be limited to the aspects disclosed herein. For example, in one aspect, the first support portion 504 can be coupled to an exterior surface of the second support portion 506, wherein the first support portion can be secured along different points of the outer surface of the second support portion. In yet other aspects, an intervening structure could be present to connect the first and second support portions 504, 506 together, such as but not limited to the hinge 22 of FIG. 1 discussed above, or a hinge similar to the base extension hinge 508 discussed herein. The first support portion 504 and/or the second support portion 506 can be permanently coupled to the intervening structure or removably coupled to the intervening structure, while yet being able to adjust the positioning of either first support portion or the second support portion with respect to the intervening structure and/or the opposing support portion. In some aspects, the first and/or second support portions can be telescopic support portions such that each can comprise one or more portions that can extend and/or retract such that the size of the first and/or second support portion can be adjusted.

Figure 7:
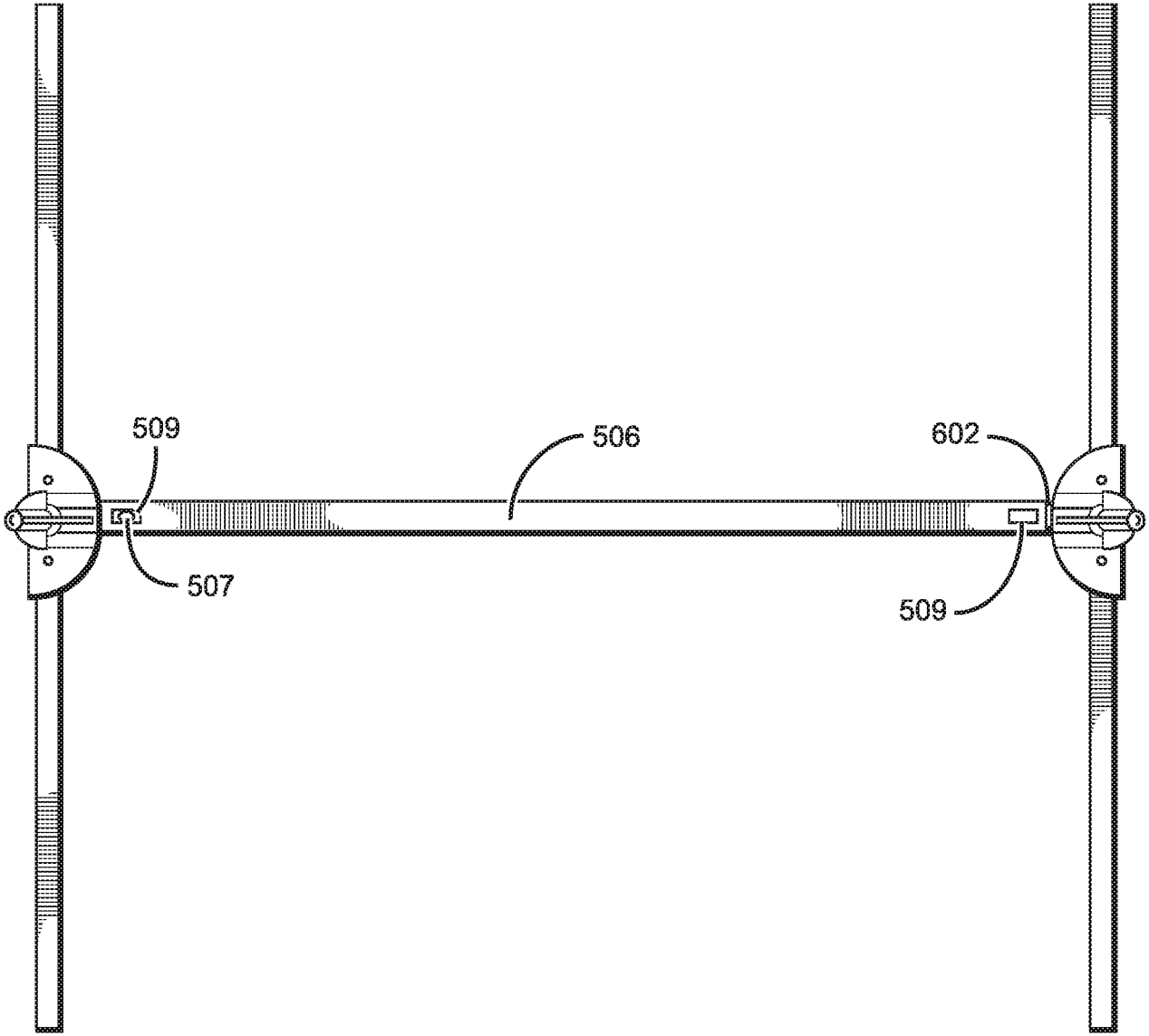
FIG. 7 is a top plan view of the base structure of FIG. 6.
Figure 8:
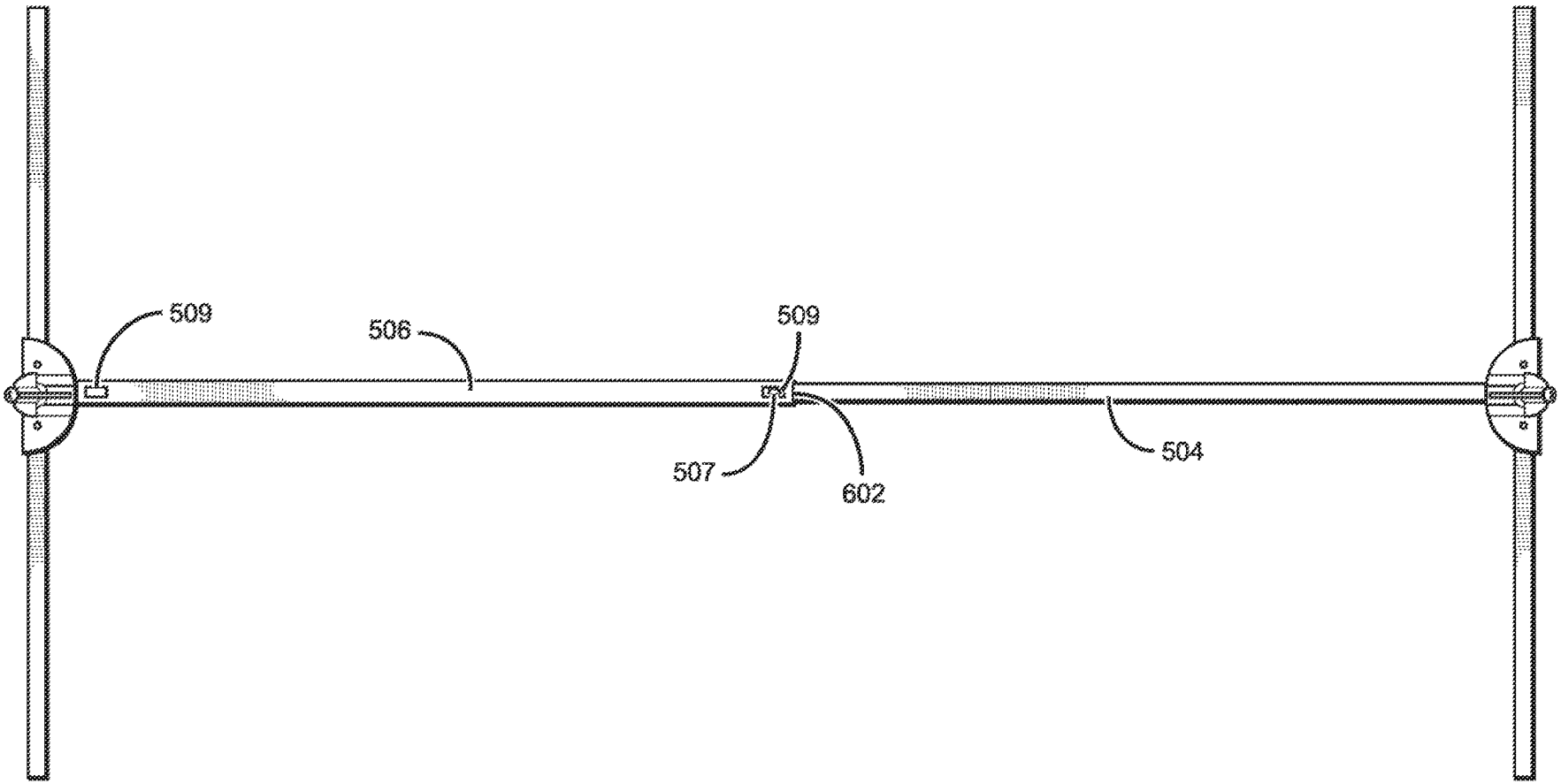
FIG. 8 is another top plan view of the base structure of FIG. 6.

In one aspect, the first and second support portions 504, 506 are axially aligned along the same axis, such that the first support portion 504 is received within the second support portion 506. The positioning of the first and second support portions can be adjusted by sliding at least one of the first and/or second support portions with respect to the other support portion. For example, in the aspect of FIG. 7, the first support portion 504 is received within the second support portion 506, wherein the locking pin 507 is engaged with the opening 509 that is opposite the open end 602 of the second support portion 506. Disengaging the locking pin 507 from the opening 509 allows the positioning of the first support portion 504 within the second support portion 506 to be adjusted. With reference to FIG. 8, the first support portion 504 can be adjusted to be removably coupled to the second support portion 506 at the opening 509 proximate the open end 602 of the second support portion 506. In the aspect of FIG. 7, the first and second support portions 504, 506 are locked in a first configuration. The configuration can be altered by adjusting the positioning of the first support portion within the second support portion, such that the first and second support portions are locked in a second configuration, as shown in FIG. 8. The positioning of the first support portion 504 within the second support portion 506 can be easily adjusted by disengaging the locking pin 507 from the at least one openings 509 and engaging the locking pin 507 in the desired at least one openings 509. The adjustability of the first and second support portions 504, 506 allows the base structure to be configured into different sizes, thereby allowing different nets to be used with the ball net structure. In the aspect of FIG. 7, the size of the base structure is smaller in comparison to the size of the base structure shown in FIG. 8. The first support portion 504 can be easily adjusted from the configuration disclosed in FIG. 8 back to the configuration disclosed in FIG. 7 by disengaging the locking pin 507 and sliding the first support portion 504 into the second support portion 506 and engaging the locking pin 507 with the opening 509 that is opposite the open end 602 of the second support portion 506.

The first and second support portions 504, 506 can be configured in many different ways and are not intended to be limited to the aspects disclosed herein. In the aspects of FIGS. 7 and 8, the second support portion 506 comprises two openings 509, but in other aspect, the second support portion 506 can comprise a plurality of openings 509 such that the first support portion 504 can be coupled to the second support portion at any one of the plurality of openings. In yet other aspects, the respective lengths of the first and second support portions can be the same and/or different. In yet other aspects, the first and second support portions are not axially aligned. The first and second support portion can be arranged in many different ways and are not intended to the aspects disclosed herein. For example, the first and second support portions can be parallel with respect to each other, while in other aspects, the first and second support portions could be arranged at an angle with respect to each other. In yet other aspects, the position of the first support portion can be adjusted with respect to the second support portion while not being received by the second support portion.

At least one advantage of the disclosure is the ability to alter the configuration of the base structure. The configuration of the base structure can be altered, in part, due to the positioning of the first and second support portions 504, 506 being adjustable. The adjustability of the positioning of the first and second support portions allows the first support portion to be secured along different openings of the second support portion, thereby allowing the base structure to be adjusted to different sizes. The base structure being adjustable to different sizes allows the ball net structure to be used with nets of different sizes and/or configurations. The base structure is compatible with various sized nets that can be used for different activities. In some aspects, the separation of the first and second base extension hinges can be determined, in part, by the length of the first and/or second support portions and/or by the positioning of the first support portion within the second support portion. In the aspects of FIGS. 7 and 8, the first and second support portions are similar in length and the separation of the first and second base extension hinges is altered by adjusting the positioning of the first support portion within the second support portion. In some aspects, the nets that are compatible with the disclosure are based, in part, by the separation of the first and second base extension hinges. However, in other aspects, the nets compatible with the disclosure do not depend on the separation of the first and second base extension hinges. Typically, nets are used with a dedicated frame structure that is only intended to be used with one type of net, and is not able to be adjusted so that a different net can be used on the dedicated structure. As such, users would have to purchase multiple dedicated net framing structures each using a different net for different sports-related activities and/or training, which can be costly. The disclosure allows different nets to be used on the same base structure by adjusting the base structure as needed, so that users would only have to purchase the nets and not multiple framing structures of the net.

The base structure 502 of the ball net structure 500 comprises a first base extension hinge 508 and a second base extension hinge 510. The first and second base extension hinges 508, 510 receive the respective first and second support portions 504, 506, as shown in FIG. 5. The first and second base extension hinges 508, 510 further receive the respective first and second base extensions 512, 514, as also shown in FIG. 5. In the aspect of at least FIG. 5, the base structure 502 comprises two first base extensions 512 and two second base extensions 514, but it is understood that the base structure can comprise one or more first base extensions and/or one or more second base extensions and is not intended to be limited to the aspects disclosed herein.

The first and second base extension hinges 508, 510 can be substantially similar. As such, a discussion of the first base extension hinge 508 will be presented herein with the understanding that such disclosure can be applicable to the second base extension hinge 510, in an effort to reduce duplicate descriptions. However, the disclosure does not require the first and second base extensions hinges to be identical. In some aspects, the first and/or second base extension hinge 508, 510 can comprise some of the same elements disclosed herein. While in other aspects, the first and/or second base extension hinges do not necessarily comprise some of the same elements of the other base extension hinge(s). Additionally, the first and second base extensions 512, 514 can be substantially similar, and the following discussion referring to the first base extension 512 is understood to be applicable to the second base extension 514. However, the first and second base extension do not have to be identical. In some aspects, the first and/or second base extensions 512, 514 can comprise some of the same elements disclosed herein, while in other aspects, the first and/or second base extensions do not comprise some of the same elements of the other base extension(s).

Figure 12:
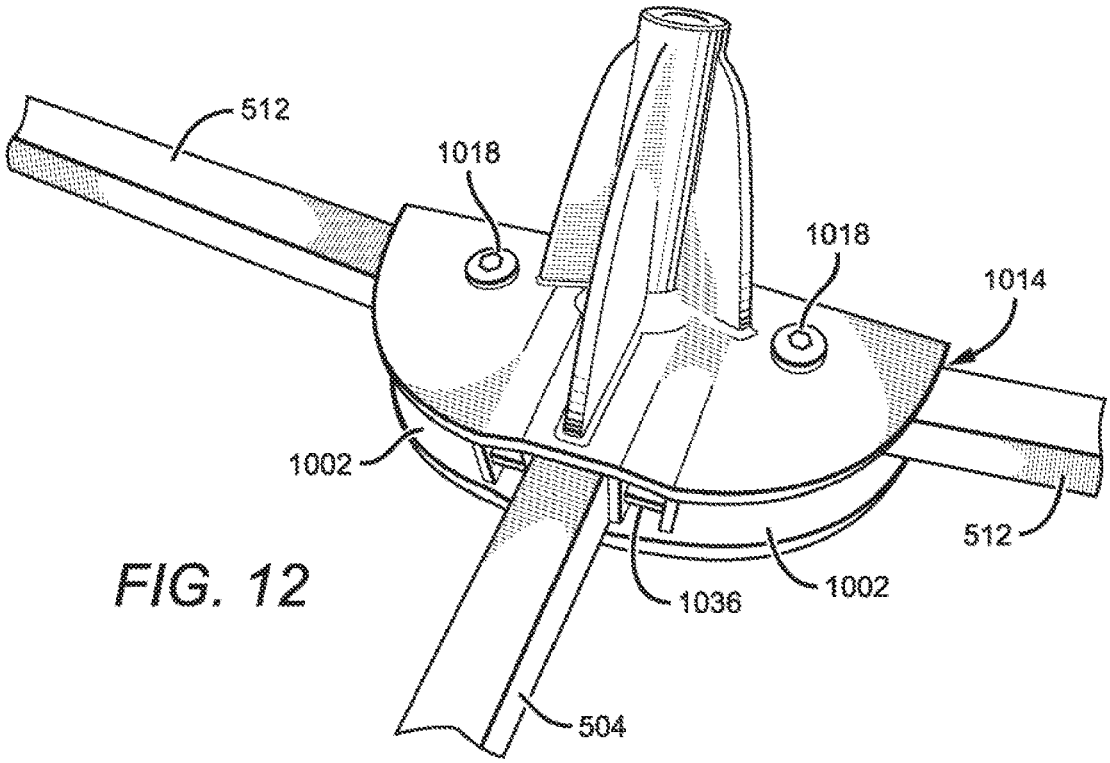
FIG. 12 is a perspective view of a base structure according to an aspect of the disclosure.
Figure 13:
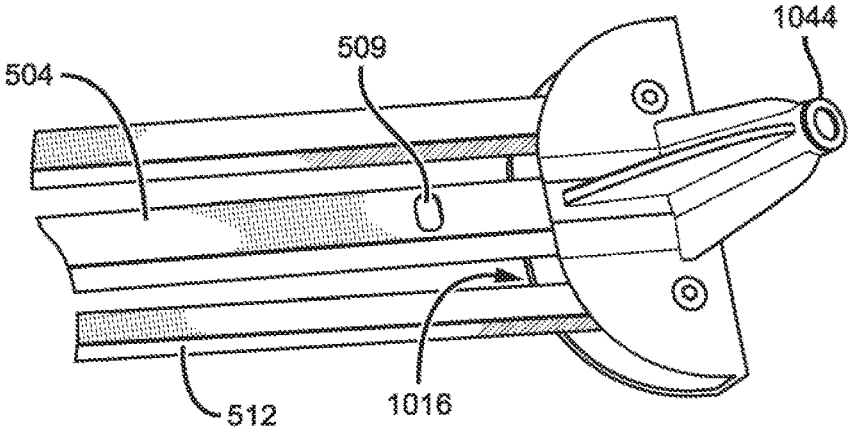
FIG. 13 is a perspective view of a base structure according to an aspect of the disclosure.

The first base extension hinge 508, as shown in FIG. 10, comprises at least one groove 1002 and a pivot 1004, wherein part of the first base extension 512 is received in the at least one groove 1002 and coupled to the first base extension hinge 508 such that the first base extension 512 can pivot about the pivot 1004 within the at least one groove 1002. The at least one groove 1002 comprises at least one groove sidewall 1006, a groove base 1008 and a groove top 1010, wherein the at least one sidewall 1006 at least partially defines the range of which the first base extension 512 can pivot within the at least one groove 1002. The first base extension hinge comprise a stop 1012 that assists in preventing substantial movement of the first base extension 512 within the at least one groove 1002. In some aspects, the stop 1012 maintains the positioning of the first base extension 512 while positioned at the ends of the range of pivot motion within the groove 1002, such that the first base extension 512 is secured and does not freely move. In one aspect, the range of pivot motion can comprise an opened end 1014 wherein the first base extension 512 is deployed, as shown in FIG. 12, and a closed end 1016 wherein the first base extension 512 is retracted and proximate the first support portion 504, as shown in FIG. 13. The stop 1012 provides an obstacle or physical structure to maintain the positioning of the first base extension 512 at either the opened end 1014 or the closed end 1016. The stop 1012 can be shaped to partially correspond to part of the first base extension 512 received within the groove 1002. In some aspects, the stop 1012 comprises a first edge 1013 that is proximate the first base extension 512 when positioned at the opened end 1014. In some aspects, the stop 1012 can comprise a second edge 1015 that is proximate the first base extension 512 when positioned at the closed end 1016. The stop 1012 comprises an elevated or raised surface with respect to the groove base 1008 such that the first and second edges 1013, 1015 provide a physical barrier that assists to maintain the first base extension 512 at either the opened end 1014 or the closed end 1016. The stop 1012 prevents the first base extension 512 from freely moving within the groove 1002, and assists in stabilizing the base structure 502. In some aspects, the first and second edges 1013, 1015 extend from the groove base 1008 to the same height. While in other aspects, the first and second edges 1013, 1015 extend from the groove base 1008 to different heights. In some aspects, at least part of the first and second edges 1013, 1015 can contact part of the first base extension 512 to maintain the position of the first base extension 512. The stop 1012 provides resistance to prevent slight movement of the first base extension 512, but does not prevent the first base extension 512 from moving between the opened end 1014 and the closed end 1016. The stop 1012 can be configured in many different ways and is not intended to be limited to the aspects disclosed herein. In the aspect of FIG. 10, each groove 1002 comprises one stop 1012 on the groove base 1008. However, in other aspects, each groove 1002 can comprise one or more stops 1012 on the groove base 1008. In some aspects, one or more stops 1012 can be on the at least one groove sidewall 1006, the groove base 1008, the groove top 1010, or a combination thereof.

When the first base extension 512 is positioned at the closed end 1016 of the groove 1002, the base structure 502 is in a closed state and in condition to be stored for later use. When the first base extension 512 is positioned at the opened end 1014 of the groove 1002, the base structure 502 is in a deployed condition and ready to be used. The range of pivot motion of the first base extension 512 is not intended to be limited to the aspects described herein. For example, the range of pivot motion of the first base extension 512 between the closed end 1016 and the opened end 1014 within the groove 1002 can range from about 0 to 90 degrees. However in some aspects, the range of pivot motion of each and/or some of the base extension from the closed end to the opened end of the respective groove can range from about 0 to 180 degrees. In some aspects the range of pivot motion of the base extensions can be the same, while in other aspects the range of pivot motion can be different for the base extensions.

The first base extension 512 is coupled to the first base extension hinge 508 by a pin 1018, such that the first base extension 512 is adapted to pivot within the groove 1002 about the pivot 1004. In the aspects of FIGS. 12 and 13, the first base extension hinge 508 comprises two grooves 1002, two pins 1018 and two first base extensions 512, wherein a respective first base extension 512 is partially received within a respective groove 1002 and coupled to the first base extension hinge 508 by a respective pin 1018. In the aspects of FIGS. 12 and 13, each pin and base extension are opposite each other. In other aspects, the base extension hinge can comprise any number of base extensions and/or grooves, and is not intended to be limited to the aspects disclosed herein.

Figure 15:
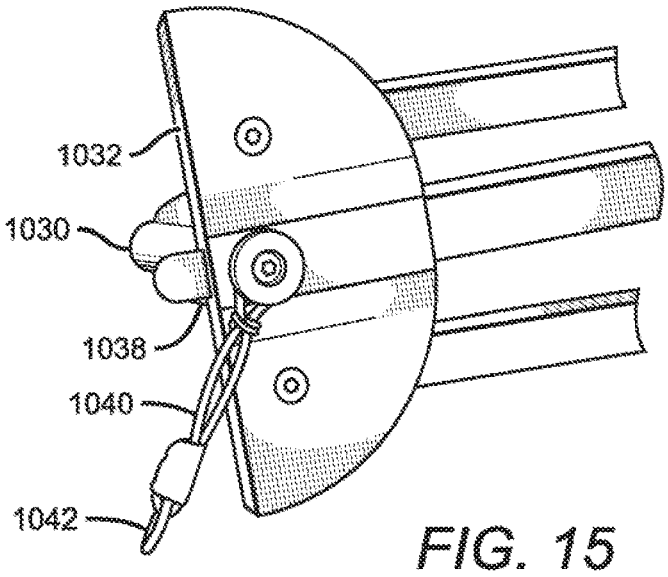
FIG. 15 is a bottom view of a base structure according to an aspect of the disclosure.
Figure 18:
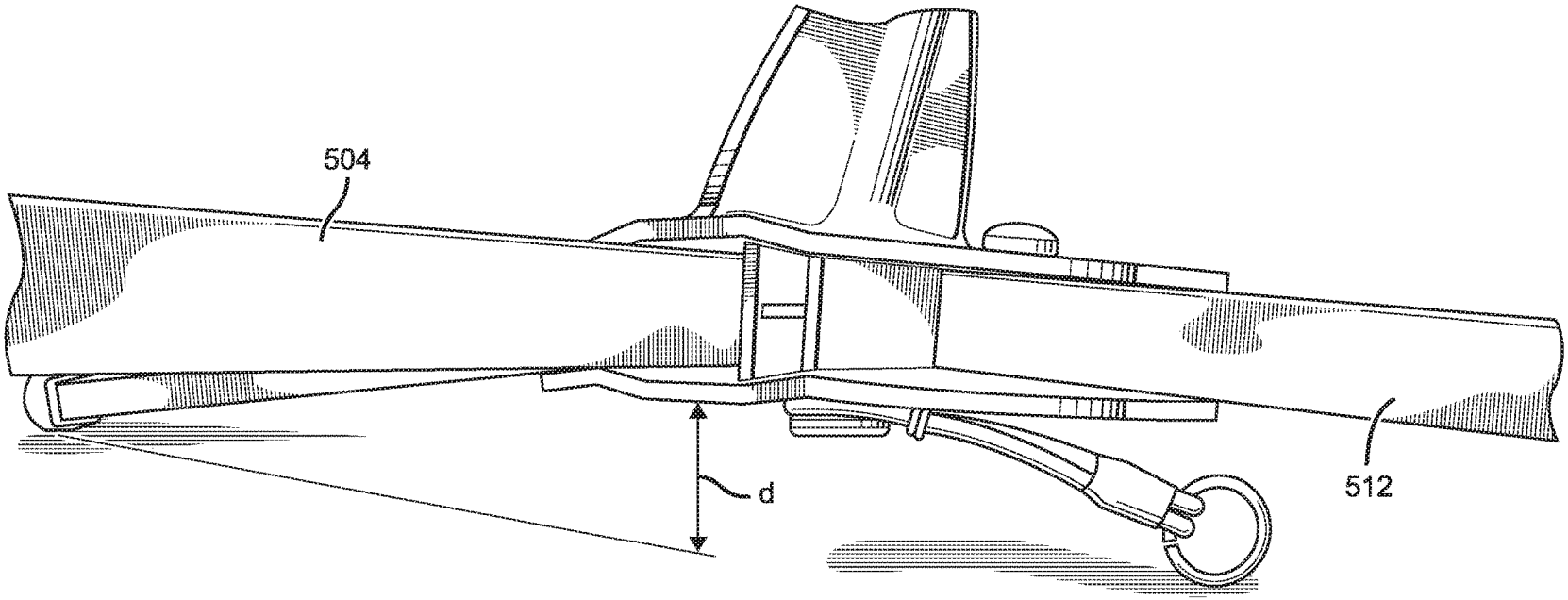
FIG. 18 is a side view of a base structure according to an aspect of the disclosure.

The first base extension hinge 508 further comprises a channel 1020 to receive the first support portion 504, as shown in FIG. 12. The channel 1020 comprises a top 1022, a base 1024, and sidewalls 1026 wherein the channel 1020 is proximate the at least one groove 1002 of the base extension hinge 508. In the aspect of FIG. 10, the first base extension hinge 508 comprises two grooves 1002 opposite each other with the channel 1020 interposed between the opposing grooves 1002. In some aspects, the channel 1020 can comprise at least one rib 1028 within the channel 1020 to assist in securing the first support portion 502 within the channel 1020. In some aspects, the at least one rib 1028 can be arranged within the channel 1020 such that the channel 1020 can accommodate the dimensions of the first support portion 504 that is received within the channel 1020, as shown in FIG. 18. In other aspects, the at least one rib 1028 can be arranged within the channel 1020 such that part of the first support portion 504 received within the channel 1020 at least partially contacts at least one of the top 1022, base 1024, sidewall 1026, and/or a combination thereof. The at least one rib 1028 at least partially extends along the length of the channel 1020. The at least one rib 1028 can be a continuous rib, while in other aspects, the at least one rib 1028 can comprise a plurality of ribs that are separated and aligned to form the at least one rib. In some aspects, the channel 1020 can comprise a plurality of ribs 1028 that contact part of the first support portion 504 that is received in the channel 1020 such that the plurality of ribs 1028 prevent the first support portion 504 from shifting and/or moving while in the channel 1020. In one aspect, the at least one rib 1028 can be at the intersection of the sidewall 1026 and the top 1022 and/or base 1024. However, the at least one rib 1028 can be arranged in many different locations within the channel 1020 and is not intended to be limited to the aspects described herein. In some aspects, the at least one rib 1028 can be on a sidewall 1026, the top 1022, the base 1024, or a combination thereof. In some aspects, the channel 1020 can comprise at least one rib 1028 at an intersection of the top 1022 and the sidewall 1026, the base 1024 and the sidewall 1026, the top 1022, the base 1024, the sidewalls 1026, or a combination thereof. The first base extension hinge 508 can further comprise a channel lock pin 1030 to couple the first support portion 504 within the channel 1020, as shown in FIG. 15. The channel lock pin 1030 in the aspect of FIG. 15 is disclosed as being at a bottom surface 1032 of the first base extension hinge 508. However, the channel lock pin 1030 is not intended to be limited to the aspects described herein. In some aspects, the channel lock pin 1030 can be at the top surface or any other surface of the first base extension hinge 508 in order to couple the first support portion 504 within the channel 1020.

Figure 14:
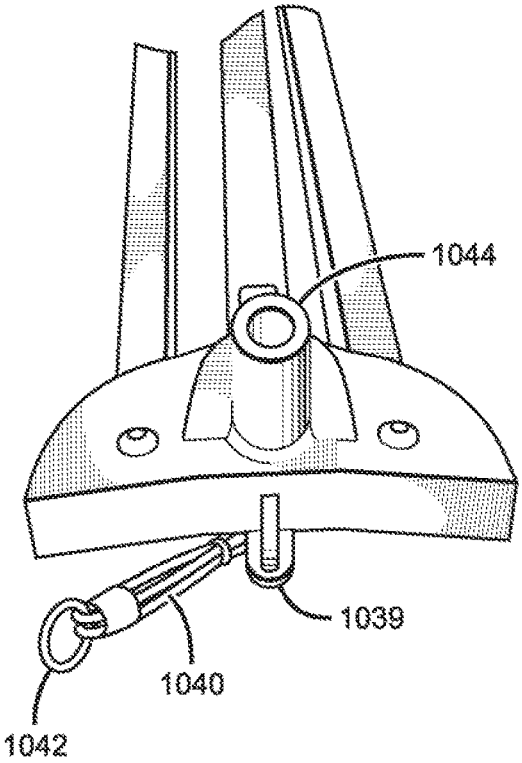
FIG. 14 is a side view of a base structure according to an aspect of the disclosure.

The first base extension hinge 508 can further comprise at least one cavity 1034, wherein the at least one cavity 1034 is interposed between the groove 1002 and the channel 1020. In the aspect of FIG. 10, the first base extension hinge 508 comprises two cavities 1034, wherein each cavity 1034 is interposed between the channel 1020 and a respective groove 1002. The cavity 1034 provides a separation between the channel 1020 and the groove 1002 to allow for the first support portion 504 to be separated from the first base extension 512 when the first base extension 512 is positioned in the closed end 1016 within the groove 1002. With reference to FIGS. 13-14, the separation between the first support portion 504 and the first base extension 512 prevents the first base extension 512 from hitting and/or striking the first support portion 504 when being positioned into and/or when positioned in the closed end 1016. The separation assists in preventing damage to either the first support portion 504 and/or the first base extension 512, which can prolong the durability of the ball net structure 500. In some aspects, the at least one cavity 1034 can comprise at least one bridge 1036, as shown in FIG. 12. The at least one bridge 1036 can extend between the channel 1020 and the groove 1002. The at least one bridge 1036 can provide further structural support to the first base extension hinge 508, and assist the first base extension hinge 508 in withstanding loads and/or forces exerted onto the ball net structure 500.

Figure 19:
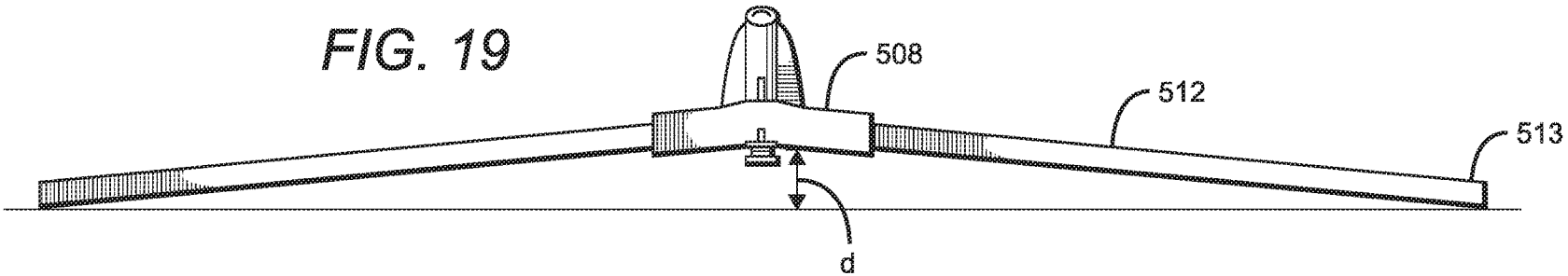
FIG. 19 is a side view of a base structure according to an aspect of the disclosure.

FIGS. 18 and 19 show an aspect of the first base extension hinge 508, wherein the first base extension hinge 508 is angled such that when the at least one first base extension 512 is deployed, at least the first base extension hinge 508 is raised off the ground or surface a distance "d" and part of the at least one first base extension 512 is on the ground or surface. In one aspect, the at least one groove 1002 of the first base extension hinge 508 is set at an angle towards the ground or surface. As a result, the first support portion 504 and the first base extension hinge 508 of the base structure 502 are raised off the ground or surface by at least the distance "d" while part of the at least one first base extension 512 is on the ground. In some aspects, a base extension end 513 of the first base extension 512 is opposite the first base extension hinge 508 and contacts the ground or surface when the first base extension 512 is deployed, as shown in FIG. 19. However, in some aspects, at least a portion of the first base extension 512 contacts the ground or surface when deployed. The angle of the at least one groove 1002 can be set at any degree towards the ground or surface, and in some aspects can be within a range of 0 to 90 degrees. In the aspects of FIGS. 18 and 19, the first base extension hinge 508 comprises two grooves 1002 and two first base extensions 512, wherein each groove 1002 is angled such that the first base extension hinge 508 and first support portion 504 are raised off the ground when the first base extensions 512 are deployed. The disclosure is not intended to be limited to the aspects disclosed herein. In other aspects, the first base extension hinge 508 can comprise one or more grooves 1002. In such aspects, the one or more grooves 1002 can be angled with respect to the surface, wherein the one or more grooves 1002 are set to the same or different angle. In yet other aspects, the one or more grooves 1002 are not angled with respect to the surface such that the one or more grooves 1002 are substantially parallel to the surface. While in other aspects, one groove 1002 can be angled with respect to the surface while another groove 1002 is not angled with respect to the surface.

The first base extension hinge 508 can further comprise at least one attachment device 1038 to assist in stabilizing the ball net structure 500 to the surface. With reference to FIGS. 11 and 14-16, the base extension hinge 508 can comprise an attachment device 1038 at the bottom surface 1032 of the first base extension hinge 508, wherein the attachment device 1038 is an extension that extends from the bottom surface 1032 of the first base extension hinge 512. The attachment device 1038 can receive an attachment cord 1040 comprising a ring 1042 which is adapted to provide additional structural support. The ring 1042 can receive a stake, weight, or similar device so as to attach the ball net structure to the ground or surface. The at least one attachment device 1038 is configured to further provide additional structural support to the ball net structure 500 which increases the stability and/or the force the ball net structure 500 can withstand. Furthermore, the at least one attachment device 1038 can also be used to maintain the positioning of the ball net structure 500 to prevent shifting of the ball net structure 500. In other aspects of the disclosure, the ball net structure 500 comprises a plurality of attachment devices 1038 and can be on the first support portion 504 and/or the first base extensions 512. In yet other aspects, the attachment device 1038 can be located on different locations on the first base extension hinge 508 and is not intended to be limited to being at the bottom surface 1032. In yet other aspects, an attachment device 1038 can be on at least one of the first support portion 504, first base extension hinge 508, first base extensions 512, and/or a combination thereof.

Figure 11:
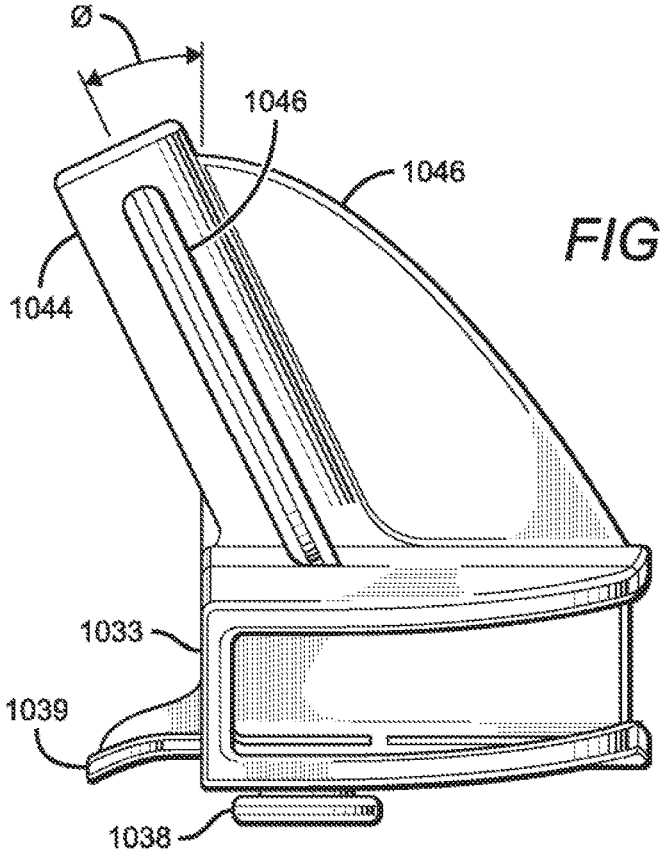
FIG. 11 is a side view of the base extension hinge of FIG. 10.

The first base extension hinge 508 further comprises a shaft 1044 extending from a top surface 1031 of the first base extension hinge 508. In some aspects, the shaft 1044 extends outward in a direction towards a back surface 1033 of the first base extension hinge 508. The shaft 1044 can be angled at an angle θ (theta) with respect to the back surface 1033 of the first base extension hinge 508, as further shown in FIG. 11. In one aspect, the shaft 1044 can be angled at an angle θ of approximately 26 degrees. However, the angle θ can be many different angles and is not intended to be limited to 26 degrees. In some aspects, the shaft 1044 can be angled at an angle θ within the range of 0 and 90 degrees. In some aspects, the shaft 1044 can comprise at least one fin 1046, wherein the at least one fin 1046 provides structural support to the first base extension hinge 508 and/or the shaft 1044. The at least one fin 1046 can comprise a planar body 1048 that is coupled to the shaft 1044 and to part of the top surface 1031 of the first base extension hinge 508. The at least one fin 1046 stabilizes the shaft 1044 and assists to withstand forces exerted onto the shaft 1044. The at least one fin 1046 can also assist in withstanding forces exerted onto any part of the ball net structure 500, such as but not limited to the base extension hinge, base extension, support portion, and/or any elements of the ball net structure 500. In the aspect of FIGS. 10-11, the shaft 1044 comprises three fins 1046. However, in other aspects, the shaft 1044 can comprise one or more fins 1046 and is not intended to be limited to the aspects disclosed herein. In some aspects, the at least one fin 1046 can comprise an attachment device 1038, similarly as disclosed above. The attachment device 1038 of the at least one fin 1046 can be configured to receive the attachment cord 1040 as discussed above to stabilize the ball net structure 500. While in other aspects, the attachment device 1038 of the at least one fin 1046 can receive part of a net 520, such as but not limited to a sleeve 524. The attachment device 1038 of the at least one fin 1046 can be configured in many different ways and is not intended to be limited to the aspects disclosed herein. In some aspects, the attachment device 1038 of the at least one fin 1046 can comprise at least one tab extending from the planar body 1048. In other aspects, the attachment device 1038 of the at least one fin 1046 comprises a notch formed within the planar body 1048. In yet other aspects, the attachment device 1038 of the at least one fin 1046 comprises an aperture in the planar body 1048 and a stud within the aperture extending from the planar body 1048.

The shaft 1044 is configured to receive a rod 516. The rod 516 is securely held within the shaft 1044, such that the shaft 1044 maintains a stable structural connection between the shaft 1044 and the rod 516 and prevents the rod 516 from being removed from the shaft 1044 when the ball net structure 500 is assembled. In one aspect of the disclosure, the shaft 1044 is similarly shaped as the rod 516, such as but not limited to cylindrically shaped, and can be larger than the rod 516 such that the rod 516 can be easily received by and/or removed from the shaft 1044. In some aspects, the shaft 1044 can comprise a sheath contacting at least part of an inner wall of the shaft 1044 that receives the rod 516. The sheath is adapted to protect the rod 516 within the shaft 1044 from forces exerted on the rod 516. As discussed above in the aspects of FIGS. 1-4, and discussed below, the rods 516 experience a moment force proximate where the rod 516 is received by the shaft 1044, and causes the rod 516 to exert a compression force upon the inner surface of the shaft 1044. The sheath, if present, protects the rod 516 from the forces exerted on and/or by the rod 516.

The shaft 1044 can be arranged in many different ways and is not intended to be limited to the aspects disclosed herein. In some aspects, the shaft 1044 can comprise a tapered inner surface such that the radius of the shaft 1044 decreases as the rod 516 is further inserted into the shaft 1044. Is such aspect, the shaft 1044 applies a compression force onto the rod 516 to form a structural connection with the rod 516. In other aspects, mechanical devices, such as but not limited to, screws, nuts, nails, rivets or the like, can be used to form the structural connection to securely attach the rod 516 to the shaft 1044. In yet other aspects, the rods 516 can comprise an attachment device such that the rods 516 can be attached to the shaft 1044; non-limiting examples of such attachment devices are the rods 516 being threaded and screwed into the shaft 1044 or the rod 516 and shaft 1044 configured similarly like a bayonet-type locking device.

In the aspect of FIG. 5, the rods 516 are circularly shaped and the shaft 1044 is also correspondingly circularly shaped to receive the rod 516. The shape of the rod 516 and shaft 1044 is not intended to be limited to a circular shape, other shapes such as quadrilateral, triangular, or any other polygonal shape can be used. The shaft 1044 can also be similarly shaped as the rod 516, but in some aspects, the shaft 1044 can be shaped differently than the rod 516. The rods 516 can be made of many different materials known in the art, such as but not limited to fiberglass or carbon fiber, such that the rods 516 are flexible, elastic, capable of returning to an initial form or state after deformation, and able to withstand the impact forces applied by sports-related balls and/or other projectiles that can be captured or caught by the ball net structure 500, or thrown, kicked, and/or hit towards the ball net structure 500.

The angle at which the shaft 1044 is angled with respect to the back surface 1033 of the first base extension 508 causes the rod 516 to extend outward at substantially the same angle as that of the shaft 1044. The rods 516, when received by the shaft 1044 flare outwards, such that the rods 516 are in a relaxed state and are substantially straight. A net 520 is arranged to receive the at least one rod 516 of the ball net structure. In some aspects, the net 520 comprises at least one sleeve 524 to receive part of at least one rod 516 of the ball net structure 500. The net 520 is adapted to exert a force on the at least one rod 516 bending the at least one rod 516 into a flexed state. The at least one rod 516 received by the at least one sleeve 524 results in the at least one rod 516 being bent from the relaxed state into a flexed state. In the aspect of FIG. 5, the ball net structure 500 comprises two rods 516, wherein each rods 516 is received by a respective shaft 1044 and at least one respective sleeve 524 of the net 520, such that both rods 516 are bent in a direction towards the base structure 502 and into the flexed state. Removal of the net 520 from at least one rod 516 allows the rods 516 to return to their original form of the relaxed state. When the at least one rod 516 is in the relaxed state, the at least one rod 516 can be easily removed from the shaft 1044 and allows the ball net structure 500 to be disassembled and stored for later use. Repeated use of the ball net structure 500 does not result in the rods 516 being permanently bent in a shape similar to that of the flexed state. In other aspects, when the at least one rod 516 is in the relaxed state, the base structure 502 can be configured into a different configuration to allow a different net to be used with the base structure 502.

The net 520 is similar to the net 30, discussed above, and imparts a pulling force on each of the rods 516 which causes the rods 516 to bend in a direction towards the base structure 502. Once bent towards the base structure 502, the rods 516 are in the flexed state and experience a moment force about its pivot point. The pivot point of each of the rods 516, in the aspect of FIG. 5, corresponds to the point at which the rods 516 are received by the shaft 1044. The moment force experienced by the rods 516 is imparted onto at least the base structure 502 and the first and second support portions 504, 506 of the base structure 502, with the transferred force being greatest at a central region of the base structure 502. This transferred force further assists in stabilizing the base structure 502 on the surface which the ball net structure 500 is on.

The net 520 can comprise a mesh surface and/or can be comprised of typical net materials known in the art. The net 520 comprises at least one sleeve 524 to receive a rod 516 and/or the base structure 502. The aspect of FIG. 5 shows the net 520 comprising a plurality of sleeves 524 that at least partially extend along opposing edges of the net 520, such that the sleeves 524 are opposite each other. The sleeves 524 of the aspect of FIG. 5 are in the form of sleeves of varying sizes on opposing edges of the net that are adapted to receive a respective rod 516. For example, on one edge the net comprises an elongated sleeve that extends along part of the edge of the net, and two smaller sleeves that are proximate a respective corner region of the net. The elongated sleeve is adapted to extend along part of the rod, and the smaller sleeves are adapted to be removably coupled to an end of the rod and/or base structure. The sleeves 524 of the net 520 can be configured in many different configurations and are not intended to be limited to the aspects disclosed herein. In some aspects, the sleeve can span the length of the rod. In other aspects, the sleeve can comprise a plurality of smaller sleeves or loops that are spaced apart from each other and run along part of the rods 516, or can comprise a sleeve that spans along a partial length of the rod 516, or can comprise a plurality of sleeves of various lengths. The at least one sleeve of the net can be arranged in many different shapes, such as but not limited to at least one sleeve that extends along a substantial portion of the rod 516, a plurality of sleeves 524 that extend along part of the rod 516, or a combination thereof. In some aspects, the sleeves are fixedly attached to the net. Whereas in other aspects, the sleeves comprise an attachment mechanism in order to removably couple the sleeves to the rod and/or base structure. In some aspects, the attachment mechanism can comprise a hook and loop system, such that the sleeves are removably coupled via the hook and loop system. In other aspects, the attachment mechanism can comprise a hook, latch, or the like in order to removably couple the sleeve to the rod and/or the base structure. The sleeves 524 receive the rods 516 and securely hold the net 520 on the rods 516 due in part to the sleeves 524 bending the rods 516.

In some aspects, the net can comprise at least one sleeve 524 adapted to be removably coupled to the rod 516. In some aspects, the net 520 can comprise at least one sleeve 524 received by an end portion of the rod 516, opposite the shaft 1044, and at least one sleeve 524 that extends along part of the rod. In some aspects, the net 520 can comprise at least one sleeve 524 that is removably coupled to the base structure 502, which assists in holding the net 520 onto the base structure 502. In some aspects, the base extension hinge 508 comprises an extension 1039 at the back surface 1033 of the base extension hinge 508 that allows for connection of the at least one sleeve 524 to the extension 1039. The extension 1039 can be at many different locations on the base extension hinge 508 and is not intended to be limited to the back surface 1033 of the base extension hinge 508. In some aspects, the extension 1039 can be on any part of the base structure 502, such as but not limited to the first and/or second support portions 504, 506, the first and/or second base extensions 512, 514, or a combination thereof. In yet other aspects, the base structure 502 can comprise a plurality of extensions 1039 to allow for the connection of at least one sleeve 524. In the aspect of FIG. 11, the extension 1039 is in the form of a tab that extends out from the base extension hinge. However, in other aspects, the extension 1039 can be arranged in many different configurations and is not intended to be limited to the aspects disclosed herein. In some aspects, the extension 1039 can be in the form of a loop coupled to the base structure. In some aspects, the at least one attachment device 1038 can also be configured to receive part of the net and/or at least one sleeve 524. In some aspects, the net 520 can comprise at least one sleeve 524 adapted to receive part of at least one of the first and second support portions 504, 506. While in other aspects, the net 520 can comprise a plurality of sleeves that receive a respective one of the first and second support portions 504, 506, first and second base extensions 512, 514, first and second base extension hinges 508, 510, or a combination thereof. The sleeves that receive the support portion and/or base extension can extend along the edge of the net that is proximate the base structure. The at least one sleeve 524 of the net can be comprised of many different materials, such as but not limited to fabric, plastic, elastic material, rope, cord, or the like.

Each rod 516 comprises an endcap 518 opposite the portion of the rod 516 that is received by the shaft 1044. The endcap 518 is configured to receive at least a portion of the sleeve and/or loop 524, such that the endcap 518 prevents the net 520 from coming off the rods 516 while the ball net structure 500 is assembled and/or in use. In some aspects, the endcaps 518 comprise a tab and a notch adapted to prevent the net 520 from coming off the rod 516. For example, the endcap 518 comprises a tab and a notch proximate the tab, such that the notch provides a depressed surface that receives the sleeve and/or loop 524 such that the sleeve and/or loop is securely held by the endcap 518 within the notch. In other aspects, the net 520 can comprise a keyhole clip configured to be removably coupled to the endcap 518. In one aspect, the keyhole clip comprises a housing comprising an opening, a groove, and a cover, wherein the keyhole clip is received by the endcap 518. In one aspect, the tab of the endcap 518 is received by the opening the keyhole clip and is slidably received with the groove, such that the notch of the endcap 518 is sized to fit and be removably coupled to the groove of the keyhole clip. The keyhole clip is thereby securely held by the endcap and is prevented from coming off the endcap while the ball net structure is assembled and/or in use. The cover of the housing covers the groove and opening, such that when the keyhole clip is received by the endcap, the cover covers the endcap and assists in maintaining the net on the rod. At least one advantage is that the keyhole clip provides for ease of installing and/or coupling the net 520 onto the rods 516. In addition, the keyhole clip being securely held by the endcap assists in keeping the net on the rods in the event that a ball and/or other projectile hits the net proximate the endcap. However, in other aspects, the endcaps 518 can have other means of preventing the net 502 from coming off the rods 516, such as but not limited to a hook, loop, locking clip, or the like.

At least one advantage of the disclosure is that the base structure 502 can compensate for forces exerted onto the base structure by the rods 516 while in the flexed state. When the net 520 is coupled and/or received by the rods that are within the respective shafts of the base extension hinge, the net exerts a pulling force onto the rods, such that the rods are in the flexed state. The rods in the flexed state exert a force onto at least the support portions 504, 506 of the base structure, and raising at least the support portions off the ground or surface allows the base structure to compensate for the force exerted onto the base structure by the rods in the flex state. The base structure can absorb the load exerted onto the support portions due to the rods being in the flexed state and distribute the load across the base structure. In one aspect, the raised support portions allows the base structure to at least partially oscillate and/or bow to dampen the load from the rods. If the support portions of the base structure were to remain on the ground, the force exerted onto the base structure by the rods in the flexed state could cause the base structure to bend and become deformed. Thus, the base extension hinges being angled such that the base extensions raise the base structure when the base extensions are deployed, seeks to counteract the force exerted onto the base structure from the rods. In other aspects, the first and/or second support portions can be bent to at least partially raise part of the first and/or second support portions in order to counteract the downward force exerted onto the base structure 502 by the rods 516 bent in the flexed state. In other aspects, the base extensions can be bent to raise the base structure when the base extensions are deployed.

The base extensions can be configured in many different configurations and are not intended to be limited to the aspects of the disclosure herein. The base extensions of at least FIGS. 18 and 19 are shown as being straight or linear. However, the base extensions are not intended to be limited to being straight or linear. In some aspects of the disclosure, the base extensions can be bent such that the bent base extensions raise the base structure off the ground or surface by the distance "d" when the base extensions are deployed. The bent base extension could be used with the angled base extension hinge to further assist in lifting the base structure from the ground or surface. In some aspects, the at least one grooves of the base extension hinge are not angled towards the ground, such that the base extension hinge is flat with respect to the ground or surface. In such aspects, the base extensions and/or the support portions can be bent such that the base structure is at least partially raised off the ground or surface. In yet other such aspects, the base extension hinge can further comprise feet that lift the base extension hinge off the ground or surface such that at least the support portions are raised off the ground or surface. In another aspect, the at least one groove of the base extension hinge can be angled away from the ground. In such aspects, the base extensions and/or support portions can be bent in order to at least partially lift the base structure off the ground or surface, or the hinge can also comprise feet that lift the base extension hinge off the ground, or a combination thereof.

The base extension hinge can be configured in many different configurations and is not intended to be limited to the aspects disclosed herein. For example, in some aspects, the base extension hinge has a general semi-circular shape, but in other aspects, the base extension hinge can comprise many different shapes and not limited to a semi-circular shape. In other aspects, the base extension hinge can comprise one groove or more than one groove. For example, in FIGS. 18 and 19, the base extension hinges comprise two grooves and a base extension pivotable within a respective groove. Additionally, the grooves are set at an angle such that the bottom surface of the base extension hinge is not substantially flat. As discussed above, the angled grooves of the base extension hinge causes the base extensions to lift the base structure when the base extensions are deployed or positioned at the opened end of the groove. Furthermore, the stop within the groove can be a raised surface that corresponds to the shape of the base extensions to prevent rotation of the base extension within the groove. In other aspects, the base extension hinge can further comprise a locking pin and/or other locking mechanism in addition to the stop to further assist in preventing the rotation of the base extension within the groove.

The base extension hinge can be formed of many different materials. In one aspect, the base extension hinge can be comprised of plastic materials, fabricated using an injection molding process. With reference to FIGS. 10, 14, 16 and 17, the base extension hinge can comprise a hole at the back surface that is aligned with the stop within the groove. The holes at the back surface are formed due to the injection molding process. The mold used to injection mold the base extension hinge comprises at least one tab wherein the material used to form the base extension hinge surrounds the at least one tab and forms the stop within the groove, such that when the mold is removed and the tab is extracted, the base extension hinge is formed and comprises the hole at the back surface of the base extension hinge. An advantage of the disclosure is that the base extension hinge is of solid construction and is not formed of separate components that are joined together. The unitary construction of the base extension hinge results in a stronger device and can bear the load of the rods exerted onto the base structure. The base extension hinge can further comprise support extensions extending from one or more surfaces of the shaft to further support the ball net structure when fully deployed and/or to withstand the force exerted by the rods onto the shaft when the net is coupled to the rod and/or when the rod is in the flexed state.

Figure 20:
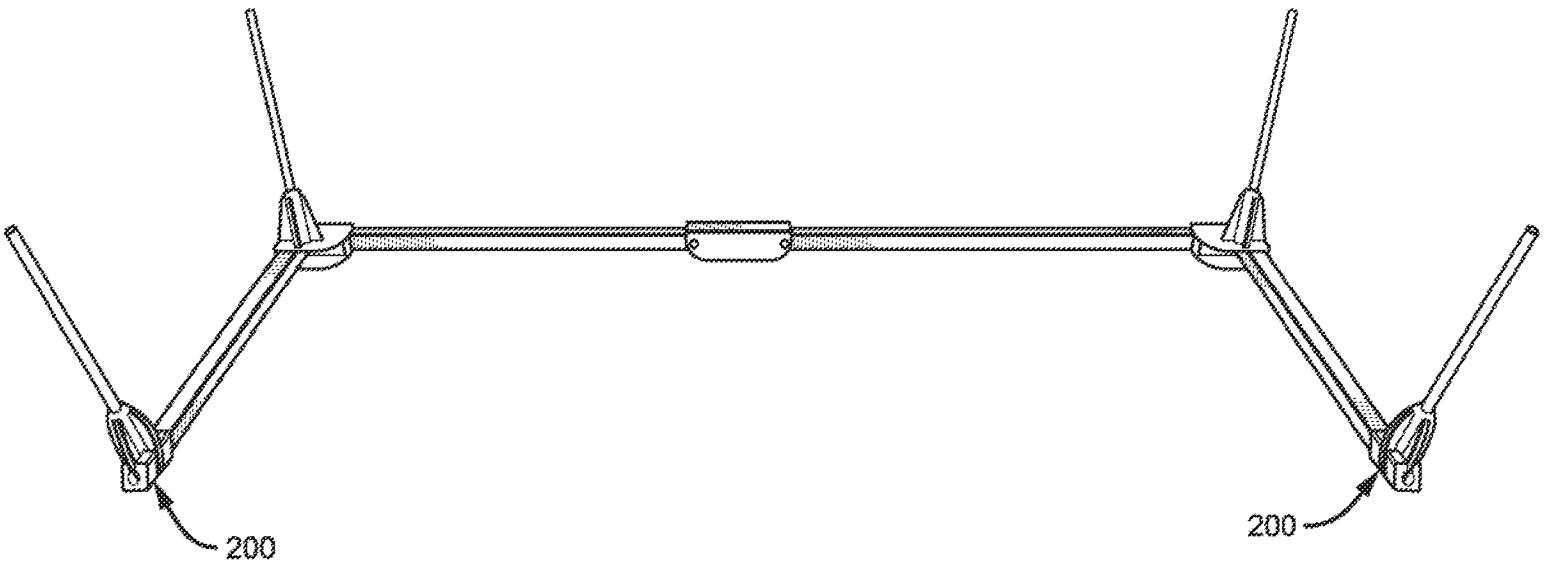
FIG. 20 is a perspective view of a base structure according to an aspect of the disclosure.
Figure 21:
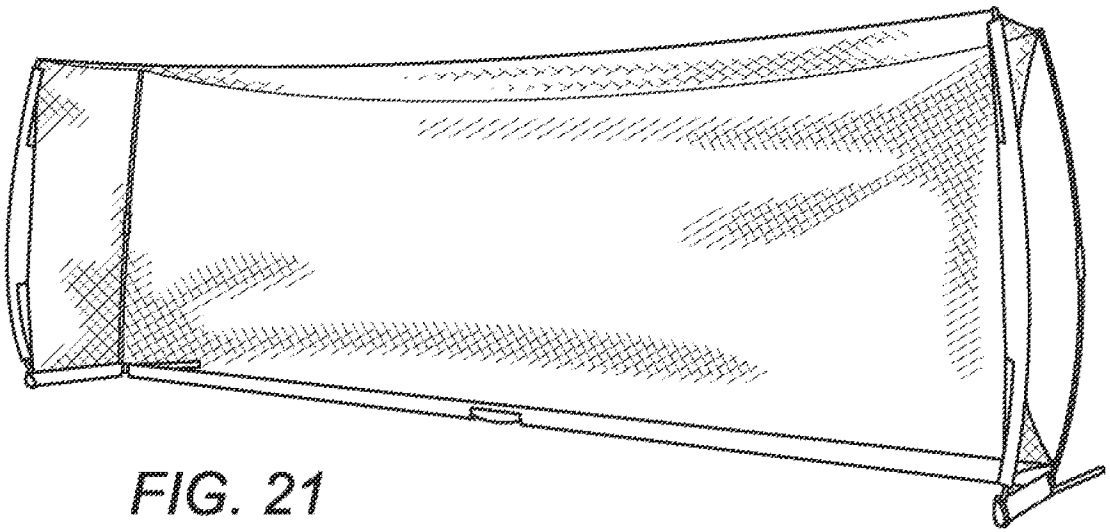
FIG. 21 is a perspective view of a ball net structure according to an aspect of the disclosure.

The base structure of the ball net structure can be configured in many different ways and is not intended to be limited to the aspects shown herein. The base structure of FIG. 5 is disclosed as having an "I" like shape, due to the base structure comprising two first base extensions and two second base extensions. In some aspects, the base structure can comprise one first and one second base extension. In other aspects, the base structure can be arranged to be shaped into many different shapes. For example, the base structure can be shaped similar to a soccer goal, lacrosse goal, baseball backstop, etc. The advantage of the disclosure is that the ball net structure can be configurable to many different arrangements to be used for many different sports, such as but not limited to, baseball, soccer, volleyball, tennis, lacrosse, football, and the like. For example, in aspects when the at least one rod 516 is in the relaxed state, the base structure 502 can be configured into a different configuration to allow a different net to be used with the base structure 502. The positioning of the first and second support portions can be altered to either increase or decrease the size of the base structure, while in some aspects, the first and/or second base extensions can receive an extension end bracket 200 configured to receive a rod to form a soccer-like goal structure, as shown in FIG. 20, wherein a soccer goal net can be used with the transformed base structure 502, as shown in FIG. 21, wherein the soccer goal net is received by the altered base structure 502, as disclosed herein and can also be adapted to be received by the extension end bracket 200, the base extensions, or a combination thereof. The extension end bracket 200 can comprise an attachment device and/or an extension similar to the attachment device 1038 and/or the extension 1039 described above. In the aspect of FIG. 20, the adjustable base structure 502 is shown with an intervening structure, such as the hinge 22, while at least one of the first and second support portions can be configured to be telescoping as discussed above such that the length of the at least one of the support portions can be adjusted. In other aspects, the adjustable base structure 502 does not comprise the intervening structure, and the base structure is adjustable by altering the position of the first support portion 504 with respect to the second support portion 506. In addition, once the base structure 502 is configured to receive a different net, such as but not limited to a soccer goal net, the base extensions that do not receive the extension end bracket can be moved to the closed end within the groove of the base extension hinge, or they can remain deployed.

FIGS. 22-25 show one aspect of the sports skills training apparatus 2200 according to an aspect of the disclosure. In some aspects, the training apparatus 2200 is configured such that the training apparatus can be deployed in an outdoor setting such as, but not limited to, a natural grass, synthetic field, dirt, concrete or the like. In other aspects, the training apparatus can be deployed in an indoor setting such as but not limited to an indoor training facility, residential or commercial setting having a synthetic or natural surface, or the like. The training apparatus can be used in sports-related activities, such as but not limited to baseball, softball, soccer, football, volleyball and the like. The training apparatus can also be used to allow users to practice kicking, hitting or throwing a ball or other projectile to the training apparatus, such that the training apparatus captures or catches the ball so that the user does not have to travel great distances to retrieve the ball. In some aspects, the training apparatus can provide a net or obstacle that a ball can travel over, under or around to assist players in improving their skills in striking the ball over the net or obstacle.

The training apparatus 2200 comprises a support portion 2202 having a first end 2204 and a second end 2206, base poles 2208 pivotally coupled to the support portion 2202 at the first and second ends 2204, 2206, base brackets 2210 coupled to a respective base pole end 2230 of the base poles 2208 opposite the support portion 2202, extensions 2212 pivotally coupled to the base brackets 2210, first and second flexible rods 2214 removably coupled to the support portion 2202, and a net 2216 configured to be received by the flexible rods 2214, wherein the net 2216 is adapted to exert a pulling force on the first and second flexible rods bending the rods from a linear state to an arcuate state, such that a net tension pulls the first rod into the arcuate state and simultaneously pulls the second rod into the arcuate state.

The support portion 2202 can be comprised of a plurality of support portions coupled to a support portion bracket 2203. In some aspects, the support portion 2202 comprises a first support portion 2205 and a second support 2207, wherein the first and second support portions are coupled to the support portion bracket 2203 such that the first and second support portions are adapted to pivot about a respective pivot 2232, 2234 of the support portion bracket 2203. The support portion bracket 2203 can be configured in a manner similar to the hinge 22 discussed above. The first support portion 2205 can be comprised of a plurality of support portions, such that the first support portion can be a telescopic support portion wherein a first telescopic support portion 2209 of the plurality of support portions of the first support portion can extend from and/or retract with respect to a second telescopic support portion 2211 of the plurality of support portions of the first support portion. The second support portion 2207 can also be a telescopic support portion in a manner similar to the first support portion. The first and second support portions being telescopic allows the first and/or second support portions to increase and/or decrease the length of the respective first and/or second support portions to accommodate for different nets. The telescopic support portions 2209, 2211 can also allow the support portion 2202 to have a reduced length such that the training apparatus 2200 could be arranged for an individual to use, while the telescopic support portions 2209, 2211 of the first and/or second support portions 2205, 2207 when fully extended can allow for multiple users to use the training apparatus simultaneously.

In some aspects, the first telescopic support portion 2205 can comprise a first inner support portion 2209 and a first outer support portion 2211, wherein the first inner support portion can be hollow and comprise an open end 602 that allows the first outer support portion 2211 to be inserted the open end 602 and received within the first inner support portion 2209. The position of the first outer support portion 2211 can then be adjusted by sliding the first outer support portion within the first inner support portion. The first inner support portion comprises at least one slot 2236 and the first outer support portion comprises at least one lock pin 2238, wherein the at least one lock pin is received within the at least one slot to lock the first inner and outer support portions together. The at least one slot 2236 and at least one lock pin 2238 can be configured in a manner similar to the openings 509 and locking pin 507, respectively, discussed above. The at least one slot 2236 of the first inner support portion allows the first outer support portion to be secured along different points of the first inner support portion, such that the first support portion 2205 can be adjusted to different sizes. In some aspects, the at least one lock pin 2238 can be a push pin within the first outer support portion. In other aspects, the at least one lock pin can be a screw, stake, or the like. The disclosure is not intended to be limited to a lock pin, and can be configured in many different ways, such that the first outer support portion is secured to the first inner support portion about the at least one slot 2236. The second support portion 2207 can be configured similar to the first support portion 2205, with the understanding that the disclosure of the first support portion 2205 is applicable to the second support portion 2207 and is not repeated herein in an effort to reduce duplicity.

Figure 22:
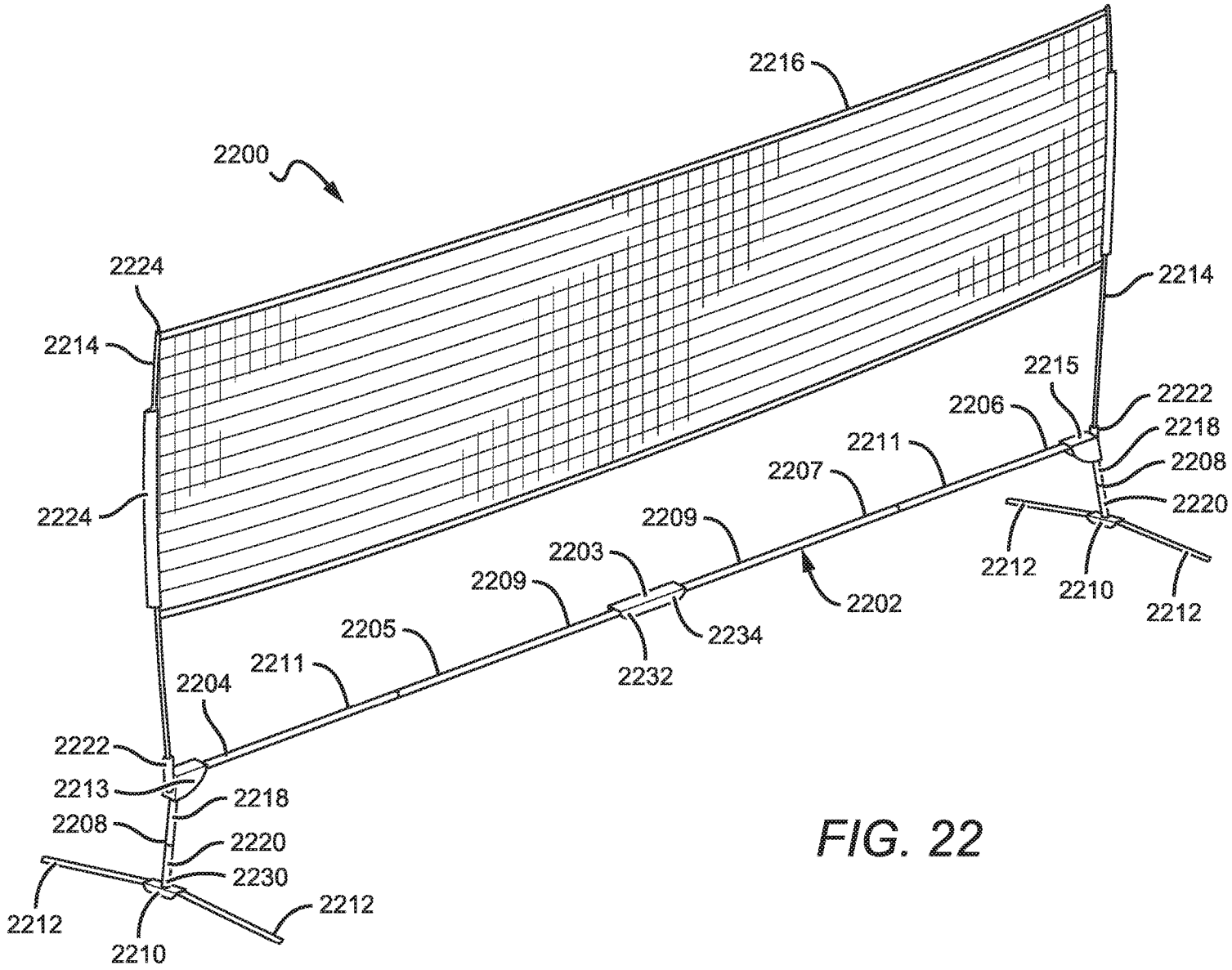
FIG. 22 is a perspective view of an aspect of a sports skills training apparatus according to an aspect of the disclosure.
Figure 23:
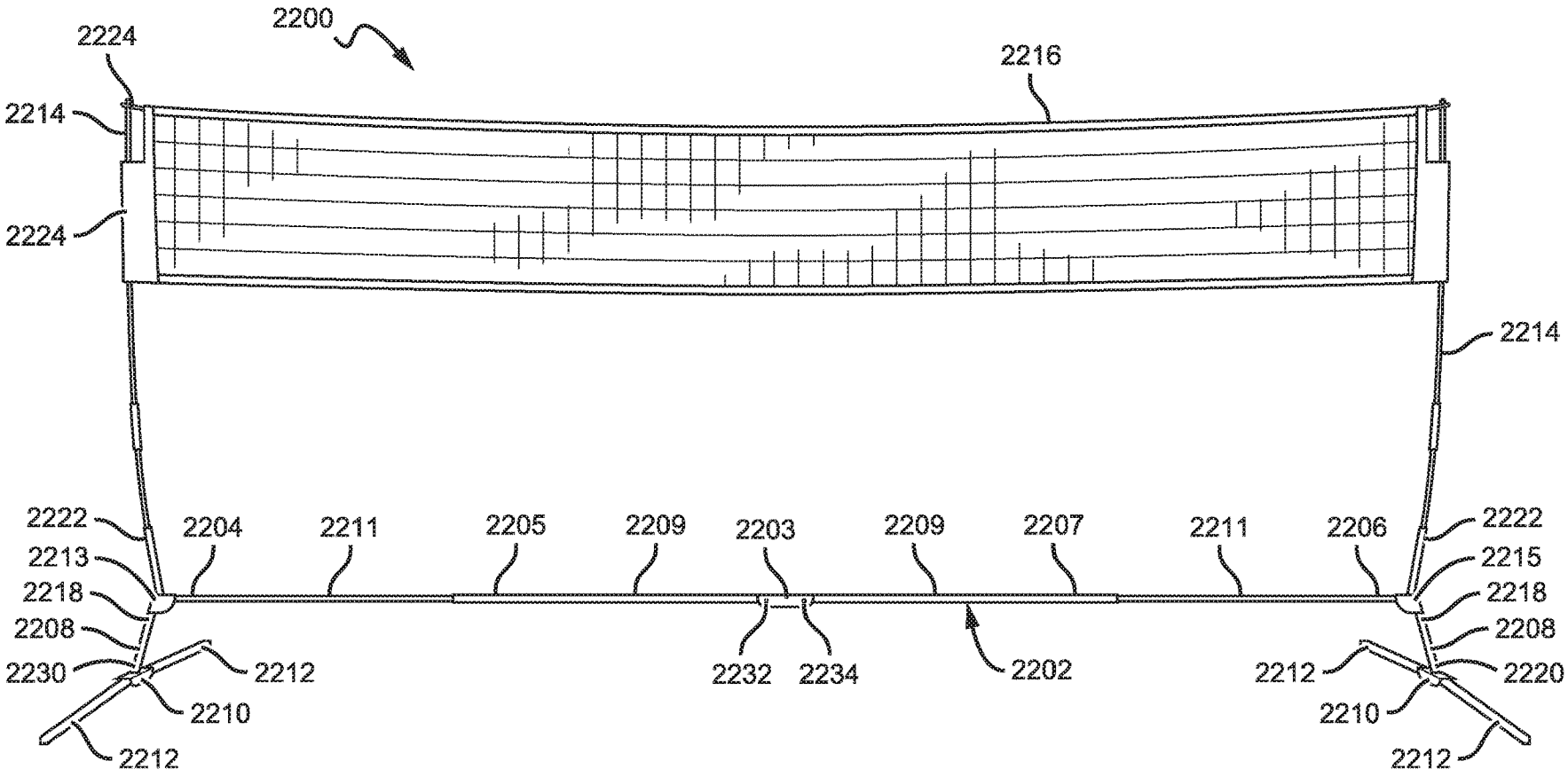
FIG. 23 is a front view of the sports skills training apparatus of FIG. 22.
Figure 24:
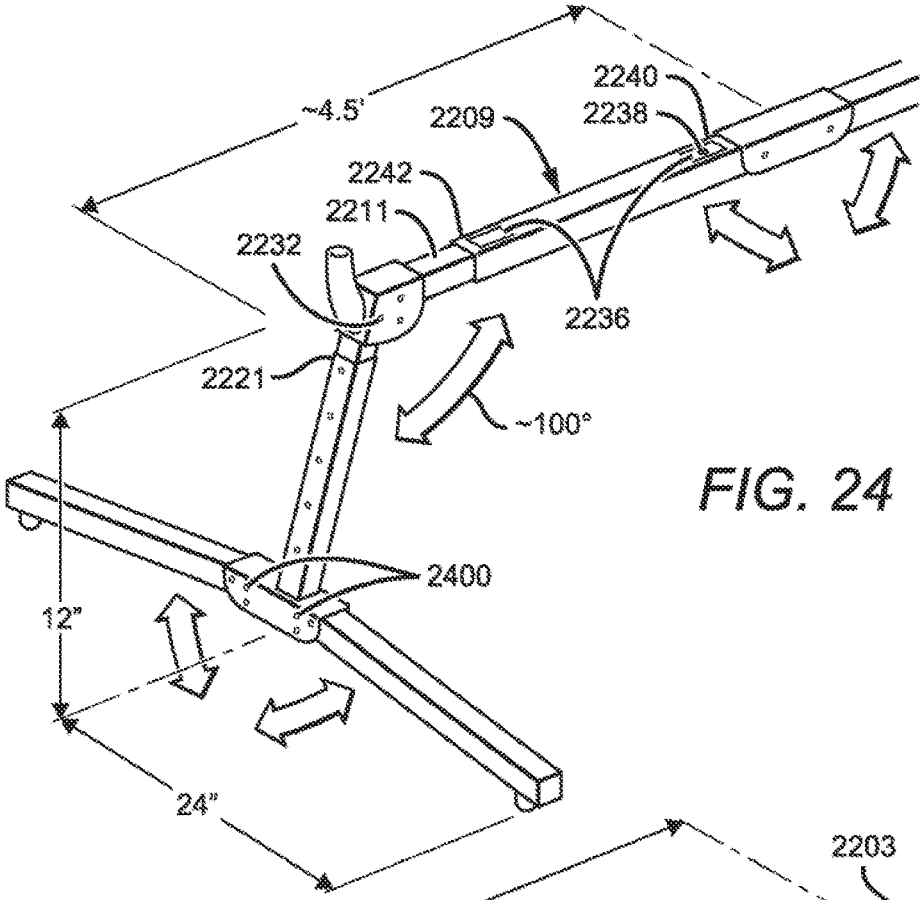
FIG. 24 is a partial enlarged view of the sports skills training apparatus of FIG. 22.
Figure 25:
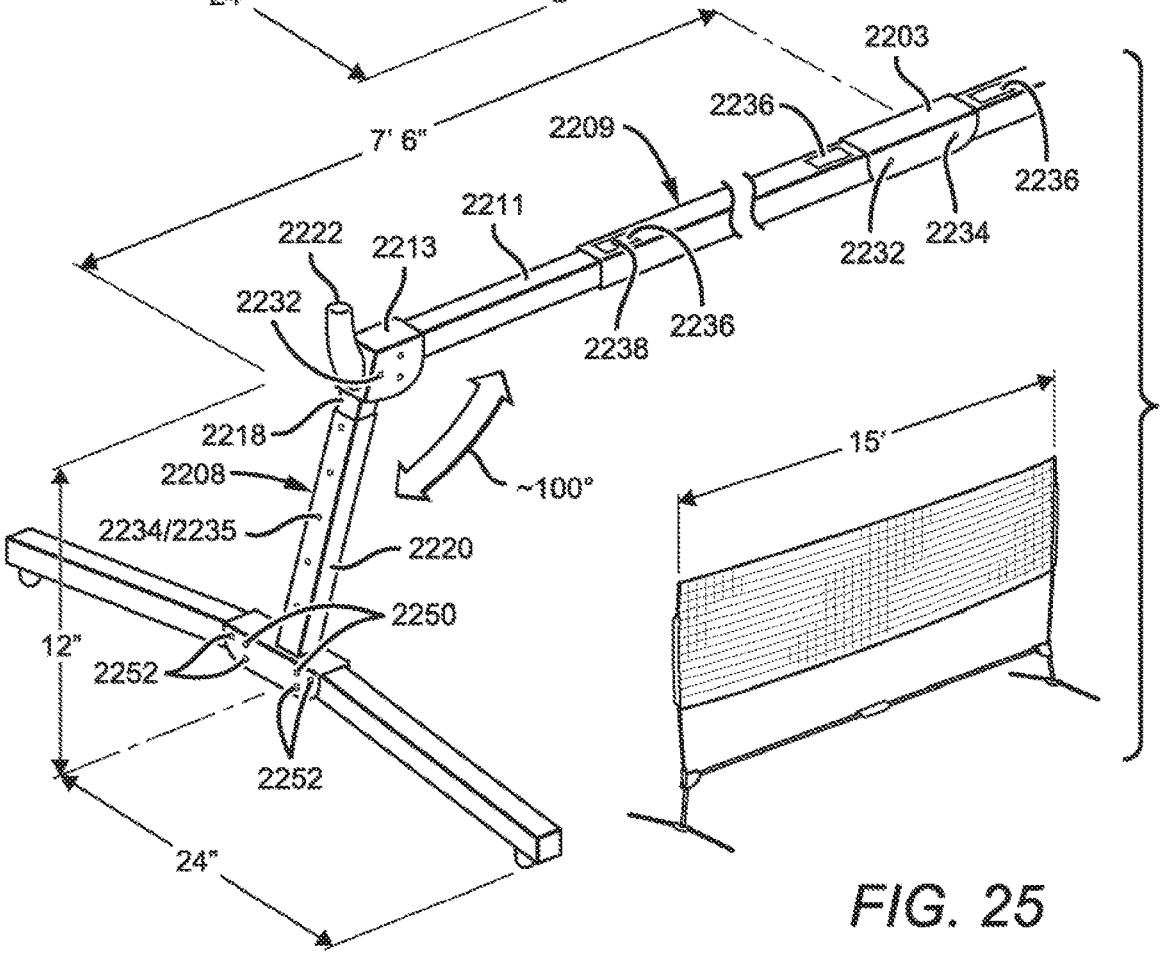
FIG. 25 is another partial enlarged view of the sports skills training of FIG. 22.

In some aspects, the first inner and outer support portions 2209, 2211 are axially aligned along the same axis, such that the outer support portion is received within the inner support portion. The positioning of the inner and outer support portions can be adjusted by sliding at least one of the inner and/or outer support portions with respect to the other support portion. For example, the outer support portion 2211 is received by the inner support portion 2209 and can be slidably adjusted within the first support portion. The outer support portion 2211 can be received by the inner support portion 2209 and locked at a first slot 2236 at a first end 2240 of the inner support portion 2209, as shown in FIG. 24. In this instance, the inner and outer support portions are locked in a first configuration, wherein the first support portion 2205 is in a retracted configuration. The configuration can be altered by adjusting the positioning of the outer support portion 2211 within the inner support portion 2209, wherein the outer support portion is locked at a second slot 2236 proximate a second end 2242 of the inner support portion 2209 such that the inner and outer support portions are locked in a second configuration, wherein the first support portion 2205 is in a deployed configuration, as shown in FIG. 25. FIGS. 22 and 23 disclose an example of the first and second support portions 2205, 2207 in the second configuration, wherein the positioning of the outer support portion within the inner support portion is adjusted such that the outer support portion is locked at a second slot at a second end of the inner support portion. In the second configuration, the length of the first support portion is longer in comparison to the size of the first support portion of the first configuration.

The inner and outer support portions can be configured in many different configurations and are not intended to be limited to the aspects disclosed herein. In some aspects, the inner support portion can comprise a plurality of slots such that the outer support portion can be secured to the inner support portion at any one of the plurality of slots. In some aspects, the lengths of the inner and outer support portions can be the same, while in other aspects, the lengths of the inner and outer support portions can be different. In one aspect, the inner support portion can be approximately 4 feet long, while the outer support portion can be approximately 3 feet long. However, the length of the inner support portion is not intended to be limited to 4 feet and can be longer or shorter than 4 feet. In addition, the length of the outer support portion is not intended to be limited to 3 feet and can be longer or shorter than 3 feet. These dimensions are non-limiting examples and the disclosure is not intended to be limited to such examples.

At least one advantage of the disclosure is the ability to alter the size and/or shape of the support portion 2202 of the training apparatus, which allows different nets to be used with the training apparatus. The training apparatus can be compatible with various sized nets that can be used for different activities. For example, the training apparatus can be configured to be used by an individual or can be configured to be used by multiple users simultaneously. Typically, nets are used with a dedicated frame structure and the dedicated frame structure is only intended to be used with one type of net, and is not able to be adjusted so that a different net can be used on the dedicated structure. As such, users would be required to purchase multiple dedicated net framing structures each using a different net for different sports-related activities and/or training, which can be costly. The disclosure allows different nets to be used on the same training apparatus by adjusting the support portion as needed, so that users would only have to purchase the nets and not multiple framing structures of the net.

The first and second support portions 2205, 2207 can be configured in many different configurations and the disclosure is not intended to be limited to the inner and outer support portions 2209, 2211 of the first and second support portions to being axially aligned. In some aspects, the outer support portion can be coupled to an exterior surface of the inner support portion, such that the outer support portion can be secured along different portions of the exterior surface of the inner support portion. In some aspects, the outer support portion comprises the hollow end and plurality of slots, wherein the outer support portion receives the inner support portion, similarly as disclosed above, instead of the outer support portion being slidably received within the inner support portion.

The support portion 2202 can further comprise a support portion bracket 2203 interposed between the first end 2204 and the second end 2206 of the support portion 2202. In some aspects, the first support portion 2205 is coupled to the support portion bracket 2203 and the second support portion 2207 is coupled to the support portion bracket opposite the first support portion 2205. The first support portion is pivotally coupled to the support portion bracket at a first pivot 2232 of the support portion bracket. The second support portion is pivotally coupled to the support portion bracket at a second pivot 2234 of the support portion bracket. The inner support portions 2209, 2209 of the first and second support portions are received by the support portion bracket 2203. When the first and second support portions are pivoted about the respective pivots 2232, 2234 into an opened position, the first and second support portions are substantially axially aligned and the training apparatus is substantially in a deployed condition. When the first and second support portions are pivoted about the respective pivots into a closed position, the first and second support portions are pivoted towards each other such that the support portion has been folded upon itself and the training apparatus is in a disassembled condition and ready to be stored.

The first end 2204 of the support portion 2202 is received by a first bracket 2213. In the aspect of FIG. 22, the first outer support portion 2211 would be received by the first bracket 2213. However, the disclosure is not intended to be limited to the aspects disclosed herein. A first base pole 2208 is coupled to the first bracket 2213, such that the first base pole is pivotally coupled to the support portion 2202. The first base pole pivots about a first pivot 2232 of the first bracket 2213, such that the base pole can pivot between a base open end and a base closed end. When the base pole is pivoted to be at the base open end, the base pole is in a deployed state such that the training apparatus is substantially assembled. When the base pole is pivoted to be at the base closed end, the base pole is proximate the first support portion 2205 such that the training apparatus is substantially disassembled. In the aspect of FIG. 25, the base pole 108 comprises a range of pivot motion of approximately 100 degrees between the base open end and the base closed end within the first bracket 2213. However, the range of pivot motion of the base pole can be less than or greater than 100 degrees and is not intended to be limited to the aspect disclosed herein. At least one advantage of the base pole pivoting within the bracket is that the base poles and extensions can be angled outward and not directly under the support portion such that the base poles and extensions are away from users and reduces the possibility of users contacting the base poles and/or extensions. Additionally, the base poles at least partially raise the support portion from the surface which also assists in minimizing users contacting the support portion 2202 when using the training apparatus. The second end 2206 of the support portion 2202 is coupled to a second bracket 2215 opposite the first bracket 2213. A second base pole 2208 is coupled to the second bracket 2215 such that the second base pole is pivotally coupled to the support portion 2202, in a manner similar to the first bracket 2213 and the first base pole 2208.

The first base pole is received by a first base bracket 2210 opposite the first bracket 2213, wherein the first base bracket 2210 comprises at least one first extension 2212. The first base bracket 2210 and the at least one first extension 2212 are configured to support the training apparatus when fully deployed and on a surface. In the aspect of FIG. 22, two first extensions 2212 are pivotally coupled to the base bracket 2210, and assist in supporting the load of the training apparatus. In some aspects, such as FIGS. 24-26, the first extensions 2212 can be pivotally coupled to the base bracket 2210 such that each extension can pivot about a pivot 2400 with respect to the base bracket. The extensions can pivot between an extension closed end and an extension opened end, such that when the extensions are pivoted into a respective extension open end, the extensions are deployed and ready to be placed on a surface. When the extensions are pivoted into a respective extension closed end, the extensions are pivoted towards each other and in a disassembled configuration. At least one advantage of the disclosure is that in having pivotable extensions is that the training apparatus can reduce its size and/or area in order to be stored in a smaller container. The first extensions 2212 are coupled to the base bracket 2210 at a base pivot 2250, wherein the first extension can comprise a locking pin that is received by a base slot 2252 in order to lock the first extensions at either the base opened end or the base closed end. The first extensions are not intended to be limited to having a locking pin to lock the extensions. In some aspects, the first extensions can comprise a stake, screw or the like to secure the first extension at either the base closed end or the base opened end. In some aspects, the first extensions are integral to the first base bracket and are not adapted to pivot.

The first base pole 2208 can comprise a plurality of base poles, such that the length of the first base pole can be adjusted, in a manner similar to the telescopic first support portion 2205 disclosed above. In some aspects, the base pole comprises an upper base pole 2218 and a lower base pole 2220, wherein the lower base pole can be substantially hollow and comprises an opened end 2221 such that the upper base pole can be inserted the open end and received within the lower base pole. The positioning of the upper base pole within the lower base pole can be adjusted by sliding the upper base pole within the lower base pole. The lower base pole comprises at least one slot 2234 and the upper base pole comprises at least one locking device 2235, wherein the at least one locking device is received within the at least one slot to lock the lower and upper base poles together. The at least one slot of the lower base pole allows the upper base pole to be secured along different points of the lower base pole, such that the length of the base pole 2208 can be adjusted to different lengths. In some aspects, the at least one locking device can be a lock pin that is received in aligned slots of the upper and lower base pole. In some aspects, the at least one locking device can be a push pin within the upper base pole that is spring loaded and received within the at least one slot of the lower base pole. In other aspects, the at least one locking device can be a screw, stake, or the like.

The adjustability of the upper and lower base poles allows the length of the base pole to be increased or decreased, which in turn allows the height of the training apparatus to be increased or decreased. In some aspects, the upper and lower base poles can be 12 inches long, such that the height of the training apparatus can be increased in part by adjusting the positioning of the upper base pole within the lower base pole. Adjusting the positioning of the upper base pole results in raising the support portion from the surface that the training apparatus is on. In the aspect of FIG. 25, the support portion is approximately raised 12 inches from the surface, and adjusting the positioning of the upper base pole can result in raising the support portion approximately 24 inches from the surface, as shown in FIG. 26. The base poles are not intended to be limited to the aspects disclosed herein. The length of the base poles is not intended to be limited to 12 inches each. In some aspects, the base poles can be shorter or longer than 12 inches. In some aspects, the upper and lower base poles can be the same length or different length. At least one advantage of the disclosure is that the height of the training apparatus can adjusted for different skilled players. For example, youth players would typically train with a net that is lower in height than that of older experienced players. As such, the training apparatus can be adjusted to accommodate various ages and/or skill levels of users training with the training apparatus.

The second base pole 2208, the second bracket 2215, second base bracket 2210, and at least one second extension 2212 are similarly configured as the first base pole 2208, the first bracket 2213, the first base bracket 2210, and the at least one first extension, respectively. Thus, the discussion of the first base pole, first bracket, first base bracket, and at least one first extension is applicable to the second base pole, the second bracket, the second base bracket, and the at least one second extension, respectively.

Figure 28:
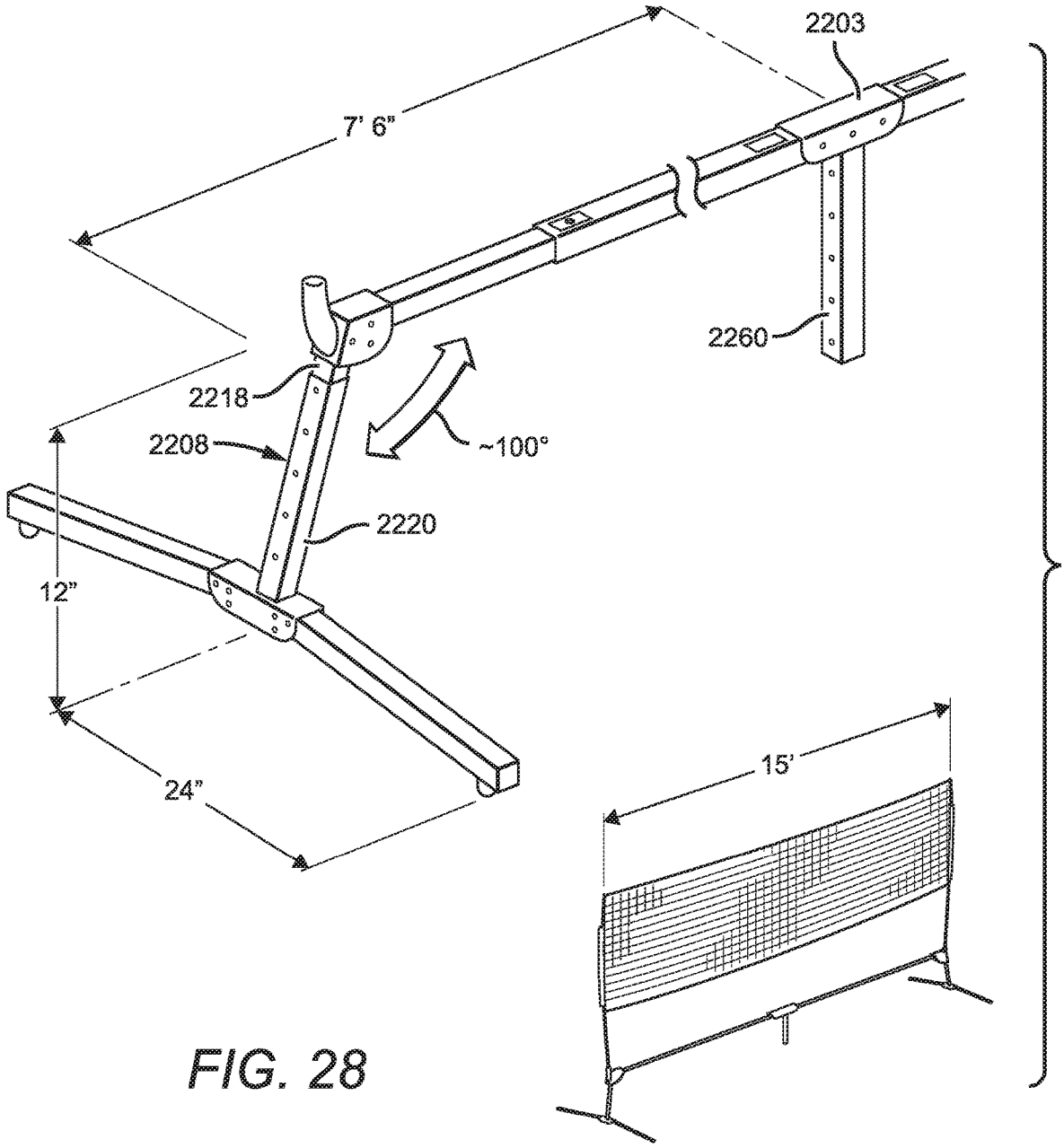
FIG. 28 is a partial enlarged view of the sports skills training apparatus of FIG. 27.

In one aspect, as shown in FIGS. 27-29, the support portion comprises a support portion leg 2260 coupled to the support portion bracket 2203. The support portion leg 2260 can provide support to the support portion such that the support portion does not bend or sag due to pressures exerted upon the support portion, as discussed below. The support portion leg can assist in further stabilizing the training apparatus on the surface the training apparatus is on. For example, in aspects wherein the telescopic first and second support portions are fully extended, the support portion leg can provide structural support such that the training apparatus does not fall over due to forces exerted onto the training apparatus by a projectile, game ball or contact from a user. The support portion leg is coupled to the support portion at a point 2270, wherein the point 2270 is interposed between first and second support portions. In some aspects, the point 2270 can be interposed between the first and second pivots of the first and second support portions. When the first and second support portions are pivoted about their respective pivots to the closed end, the first and second support portions are adjacent the support portion leg. In some aspects, the support portion leg can comprise a plurality of support portion legs coupled at any one of the first and/or second support portions. In the aspect of FIG. 29, the support portion leg comprises an inner support portion leg 2262 and an outer support portion leg 2264, wherein the outer support portion leg can be hollow and comprise an open end 2263 that allows the inner support portion leg to be inserted the open end and received within the outer support portion leg. The position of the inner support portion leg can then be adjusted by sliding the inner support portion leg within the outer support portion leg. The outer support portion leg comprises at least one slot 2268 and the inner support portion leg comprises at least one lock pin 2266, wherein the at least one lock pin is received within the at least one slot to lock the inner and outer support portion legs together. The at least one slot of the outer support portion leg allows the inner support portion leg to be secured along different points of the outer support portion leg, such that the support portion 2202 can be adjusted to different sizes. In some aspects, the at least one lock pin can be a push pin within the inner support portion leg. In other aspects, the at least one lock pin can be a screw, stake, or the like. The disclosure is not intended to be limited to a lock pin, and can be configured in many different ways, such that the inner support portion leg is secured to the outer support portion leg.

The positioning of the support portion leg is configured to correspond with the base poles 2208 such that the support portion 2202 is at the same height. With reference to FIG. 28, the base pole 2208 is fully retracted such that the upper base pole 2218 is fully received within the lower base pole 2220. The support portion leg is also fully retracted such that the inner support portion leg is fully received within the outer support portion leg. In such configuration, the support portion 2202 is shown as being elevated approximately 12"

(inches) from the surface. With reference to FIG. 29, the base pole 2208 is fully extended such that the upper base pole 2218 is fully extended from the lower base pole 2220. The support portion leg is also fully extended such that the inner support portion leg is fully extended from the outer support portion leg. In the aspect of FIG. 29, the support portion 2202 is shown as being elevated approximately 24" (inches) from the surface. The support portion leg is configured to correspond with the base pole to ensure that the elevation of the support portion is substantially consistent. The base poles and support portion leg are adjustable to change the height of the training apparatus. However, the base poles and/or the support portion leg do not have to be set to the same height setting in order to stabilize the support portion. In some aspects, the support portion leg can be set at a slot 2268 that does not correspond to the same slot 2234 of the base pole while still providing stability to the support portion and maintaining a consistent elevation from the surface. For example, the support portion leg can be set at a different height setting than the base poles in order to accommodate for unleveled surfaces. The support portion leg can be set at a higher or lower height setting than the base poles in order to correspond with the height setting of the base poles.

The training apparatus comprises first and second flexible rods 2214, 2214 removably coupled to the support portion, wherein a net is configured to be received by the flexible rods. The rods can be removably coupled along various locations on the support portion. The support portion 2202 comprises respective shafts 2222 that extend from the support portion and are configured to receive a respective flexible rod. The shafts extend outward in a direction away from the support portion and can be angled at an angle θ, such as but not limited to 26 degrees, with respect to a vertical axis of the support portion 2202. The rods, when received by the shafts, also at least partially extend along the direction as the shaft. However, the angle θ can be many different angles and is not intended to be limited to 26 degrees. In some aspects, the shaft can be angled at an angle θ within the range of 0 and 90 degrees. In the aspect of FIG. 22, the first bracket 2213 comprises a first shaft 2222, and the second bracket 2213 comprises a second shaft 2222, wherein a first rod 2214 is removably coupled to the first shaft 2222 and a second rod 2214 is removably coupled to the second shaft 2222. The shafts, in the aspect of FIG. 22, are shown as extending from a respective back surface of the brackets 2213. However, the shafts can extend from any surface of the brackets and are not intended to be limited to the back surface of the bracket. In some aspects, the shaft can extend from a side surface, a top surface, or a combination thereof. In yet other aspects, the shaft can extend from the support portion 2202 proximate the first or second ends 2204, 2206, while in other aspects, the shaft can extend from the base pole 2208.

A net 2216 is configured to be received by at least the rods in order to fully assemble the training apparatus. The net 2216 is adapted to exert a pulling force on the first and second flexible rods 2214, 2214 bending the rods from a linear state to an arcuate state, such that a net tension pulls the first rod into the arcuate state and simultaneously pulls the second rod into the arcuate state. The net comprises at least one sleeve 2224 to receive at least part of the first rod, and at least one sleeve 2224 to receive at least part of the second rod. The net is adapted to exert a force on the first and second rods bending the first and second rods into a flexed or arcuate state. The first and second rods received by the at least one sleeve results in the first and second rods being bent from the relaxed or linear state into the flexed or arcuate state. The net tension exerted by the net onto the rods simultaneously pulls the rods into the arcuate state, such that the rods are maintained in the arcuate state when the net structure is fully assembled. The net imparts a pulling force on each of the rods which causes the rods to bend into the arcuate state, such that the rods are bent towards each other. The rods, while in the arcuate state and biased towards each other, experience a moment force about a respective pivot point. The pivot point of each of the rods corresponds to the point at which the rods are received by the shaft. The force experienced by the rods is imparted onto at least the support portion and assists in stabilizing the training apparatus on the surface that the training apparatus is on. In some aspects, the force is imparted onto at least the first and second support portions 2205, 2207 and at least the support portion bracket 2203, wherein the rods can also exert a force onto the support portion bracket to lock the first and second support portions, and prevent rotation of the first and second support portions about the bracket. The rods exert a force onto the support portion bracket to lock the support portion bracket, such that the support portion bracket does not comprise a locking device and is locked due to the forces exerted by the net and/or rods when the training apparatus is fully assembled. In some aspects, the first or second support portions do not pivot with respect to the support portion bracket due to the forces exerted by the net and/or rods.

In some aspects, the net comprises a first edge, a top edge, a second edge, and a bottom edge. The first and second edges each comprise two sleeves 2224, 2224, wherein a top sleeve 2224 is removably coupled to an upper end of a respective rod, and further comprise an elongated sleeve that at least partially extends along the respective first and second edge. The elongated sleeves receive the respective rods and are shaped to at least partially bend rods. When the elongated sleeves and top sleeves are received by the rods, the net exerts a pulling force on the rods such that the rods are in the flexed state, such that a net tension pulls the first flexible rod into the arcuate state and the net tension simultaneously pulls the second flexible rod into the flexed or arcuate state. The rods are bent in a direction towards each other and at least towards the support portion 2202, such that the net tension holds the net upright, in a manner similarly to the aspect of at least FIG. 1. The tension holds the net substantially taut, such that the net can capture a ball and/or other projectile. The net can comprise a mesh surface with respective borders along the edges of the net, wherein the mesh surface is coupled to the borders.

The rods 2214, are similar to the rods 26, 516 discussed above. When the rods are received by the shafts, the rods are in a linear or relaxed state. When the net is received by the rods, the rods are in the flexed or arcuate state. Removal of the net from the rods allows the rods to return to their original form of the relaxed state. When at least one rod is in the relaxed state, the at least one rod can be easily removed from the shaft and allows the training apparatus to be disassembled and stored for later use. Repeated use of the training apparatus does not result in the rods being permanently bent in a shape similar to that of the flexed state. In some aspects, when at least one rod is in the relaxed state, the training apparatus can be configured into a different configuration to allow a different net to be used with the training apparatus, such as but not limited to a tennis net.

The configuration of the shafts and rods assist in generating the net tension and the forces exerted by the flexible rods to hold the training apparatus in an upright position, as well as locking the first and second support portions 105, 107 in a locked configuration within the support portion bracket 103, in a manner similarly as discussed above in at least the aspect of FIG. 1.

The rods can be of various length such that the height of the training apparatus can be adjusted by utilizing rods of various lengths. In some aspects, the rods can be comprised of a plurality of rods coupled together. At least one advantage of the disclosure is that the width of the training apparatus can also be adjusted. In the aspect of FIG. 25, the length of the inner support portions can be approximately 4 feet and the length of the outer support portions can be approximately 3 feet. When the outer support portions are fully extended from the inner support portions, the width of the training apparatus can be approximately 15 feet, wherein a fully extended first support portion 2205 and fully extended second support portion 2207 can each have a length of approximately 7.5 feet. The lengths of the inner and/or outer support portions can be of various lengths and are not intended to be limited to the aspects disclosed herein. Yet another advantage of the disclosure is that adjusting the width of the training apparatus can allow for using different sized nets with the training apparatus, which can allow users to perform different sports related activities. The adjustability of the height and/or width of the training apparatus also provides the advantage of not having purchase multiple net and/or training apparatuses in order to perform different training activities. For example, the training apparatus of FIG. 1 is configured like a volleyball net, and reducing the width of the support portion 102 allows a narrower net to be used allowing users to perform different activities, such as but not limited to baseball, softball or football related activities. Additionally, a reduced width support portion can receive a correspondingly sized volleyball net to allow an individual to use the training apparatus, while a full width support portion and corresponding net can support multiple users simultaneously.

At least one advantage is that the support portion can be elevated from the surface, and the height of the support portion is adjustable by either the base poles and/or the support portion leg. In some aspects, the extensions are configured such that when rotated to an opened position, the support portion is elevated from the surface. The extensions can be configured in many different ways in order to elevate the support portion. In some aspects, the extensions are bent or curved such that when deployed the support portion is elevated. In some aspects, the extensions are substantially linear and are pivotally coupled to a first and second brackets, wherein the first and second brackets are angled such that when the extensions are pivoted to the opened end and deployed, the support portion is elevated from the surface.

Although the disclosure has been described in considerable detail with reference to certain configurations thereof, other versions are possible. Ball net structures according to the disclosure can be many different sizes and can be used for many different applications, other than for sports-related activities. The ball net structure can comprise net sidewalls to form an enclosure, similar to a soccer goal, lacrosse goal or the like and can also include a plurality of hinges coupled to the support portions and/or the base extensions of base structure and support the force exerted onto the base structure of the ball net structure. In other aspects, the support portions can be adjustable to make a smaller or bigger base structure, while the size of the rods can also be adjusted to make a smaller or bigger ball net structures. The training apparatus can comprise a plurality of shafts on any one of the support portions, any of the brackets, or the extensions, or the like, or a combination thereof that receive a respective rod. In other aspects, the rods can be made of a single piece of material, whereas in other aspects, the rods can be comprised of a plurality of rod pieces that are joined together to form the rod. Therefore, the spirit and scope of the disclosure should not be limited to the versions described above.

We claim:

1. A training apparatus, comprising:
a support portion having a length in a first plane;
a first base pole received by a first pivoting means proximate a first end of the support portion;
a second base pole received by a second pivoting means proximate a second end of the support portion at a second end, wherein the first and second base poles pivot substantially in a second plane;
a first pair of extensions pivotally coupled to the first base pole opposite the support portion;
a second pair of extension pivotally coupled to the second base pole opposite the support portion;
a first flexible rod configured to be received proximate the first base pole; and
a second flexible rod configured to be received proximate the second base pole, wherein the first and second flexible rods extend in a third plane that is substantially perpendicular to the first plane.

2. The training apparatus of claim 1, further comprising:
a net coupled to at least the first and second flexible rods, the net bending the first and second flexible rods into an arcuate state such that the first and second flexible rods are biased towards each other.

3. The training apparatus of claim 1, the support portion further comprising a support portion bracket and a plurality of support portions,
wherein a first support portion is pivotally coupled to the support portion bracket and received by the first means,
wherein a second support portion is pivotally coupled to the support portion bracket and received by the second means.

4. The training apparatus of claim 3, wherein the first support portion adapted to pivot about a first pivot and the second support portion adapted to pivot about a second pivot.

5. The training apparatus of claim 3, wherein the first and second support portions are adapted to substantially pivot in a fourth plane.

6. The training apparatus of claim 1, the support portion further comprising a support portion leg coupled to the support portion.

7. The training apparatus of claim 6, wherein the support portion leg extends from the support portion in a direction substantially perpendicular to the first plane.

8. A training apparatus, comprising:
a support portion having at least a first support portion, a second support portion, and a support portion bracket, wherein a first end of the first support portion is received by the support portion bracket, and a first end of the second support portion is received by the support portion bracket opposite the first support portion;
a first bracket coupled to a second end of the first support portion opposite the support portion bracket;
a second bracket coupled to a second end of the second support portion opposite the support portion bracket;
a first base pole received by the first bracket, wherein the first base pole is adapted to pivot about a first pivot;

a second base pole received by the second bracket, wherein the second base pole is adapted to pivot about a second pivot;

first extensions pivotally coupled to the first base pole opposite the first bracket and second extensions pivotally coupled to the second base pole opposite the second bracket;

a first flexible rod received by a first supporting means proximate the first bracket; and a second flexible rod received by a second supporting means proximate the second bracket.

9. The training apparatus of claim 8, wherein the first and second extensions pivot about respective pivots between a deployed state and a closed state, such that the first and second extensions support the training apparatus on a surface in the deployed state.

10. The training apparatus of claim 8, further comprising: means for altering a height of the training apparatus on a surface.

11. The training apparatus of claim 10, wherein the first base pole comprises a first means for altering the height, and the second base pole comprises a second means for altering the height.

12. The training apparatus of claim 8, the support portion further comprising:

a support portion leg coupled to the support portion bracket, wherein the support portion leg extends substantially perpendicular from the support portion.

13. The training apparatus of claim 8, further comprising: means for altering a width of the support portion.

14. The training apparatus of claim 13, wherein the first support portion or the second support portion comprises the means for altering the width of the support portion.

15. The training apparatus of claim 8, further comprising:

a net removably coupled to part of the first and second flexible rods, the net bending the first and second flexible rods such that the first and second flexible rods are biased towards each other.

16. The training apparatus of claim 15, the net comprising at least one first sleeve configured to receive part of the first flexible rod, and at least one second sleeve configured to receive part of the second flexible rod.

17. The training apparatus of claim 16, the first flexible rod comprising a first end and a second end, wherein the first end is received by the first means for supporting the first flexible rod, and the second end comprises an endcap, wherein the at least one first sleeve is received by said endcap.

18. The training apparatus of claim 16, the second flexible rod comprising a first end and a second end, wherein the first end is received by the second means for supporting the second flexible rod, and the second end comprises an endcap, wherein the at least one second sleeve is received by said endcap.

19. A training apparatus comprising:

a support portion having a length in a first plane, at least a first support portion, at least a second support portion, a support portion bracket, and a support portion leg, wherein the at least a first support portion pivots about a first pivot of the support portion bracket, wherein the at least a second support portion pivots about a second pivot of the support portion bracket;

a first base pole pivotally coupled to the first support portion, and a second base pole pivotally coupled to the second support portion, wherein the first and second base poles pivot within a second plane that is substantially perpendicular to the first plane;

a first base bracket coupled to the first base pole, wherein a first extension is pivotally coupled to the first base bracket, and a second extension is pivotally coupled to the first base bracket opposite the first extension, wherein the first and second extensions pivot within a third plane;

a second base bracket coupled to the second base pole, wherein a third extension is pivotally coupled to the second base bracket, and a fourth extension is pivotally coupled to the second base bracket opposite the third extension, wherein the third and fourth extensions pivot within a fourth plane, wherein the third and fourth planes are substantially parallel;

a first flexible rod removably coupled to the at least a first support portion, and a second flexible rod removably coupled to the at least a second support portion, wherein the first and second flexible rods having a length within a fifth plane, wherein the fifth plane is substantially parallel to the first plane.

20. The training apparatus of claim 19, wherein the first base pole comprises a first means for adjusting the length of the first base pole, wherein the second base pole comprises a second means for adjusting the length of the second base pole, and wherein the support portion leg comprises a third means for adjusting the length of the support portion leg.

* * * * *